US011840417B2

(12) United States Patent
Matsuda et al.

(10) Patent No.: US 11,840,417 B2
(45) Date of Patent: Dec. 12, 2023

(54) SHEET BONDING APPARATUS

(71) Applicant: CANON KABUSHIKI KAISHA, Tokyo (JP)

(72) Inventors: Kohei Matsuda, Kanagawa (JP); Kentaro Kawata, Shizuoka (JP); Taku Watanabe, Shizuoka (JP); Atsushi Toda, Shizuoka (JP); Shun Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/846,124

(22) Filed: Jun. 22, 2022

(65) Prior Publication Data

US 2023/0002184 A1 Jan. 5, 2023

(30) Foreign Application Priority Data

Jun. 30, 2021 (JP) ..... 2021-108390

(51) Int. Cl.
*B65H 37/04* (2006.01)
*B65H 37/06* (2006.01)

(52) U.S. Cl.
CPC ..... *B65H 37/04* (2013.01); *B65H 37/06* (2013.01); *B65H 2301/51614* (2013.01); *B65H 2301/51616* (2013.01); *B65H 2801/06* (2013.01); *B65H 2801/27* (2013.01)

(58) Field of Classification Search
CPC ..... B65H 2801/06; B65H 2301/51614; B65H 2301/51616; B65H 37/04; B65H 37/06; G03G 15/2003; G03G 2215/00835; B41L 23/20; B41L 23/22
USPC ..... 399/313
See application file for complete search history.

(56) References Cited

U.S. PATENT DOCUMENTS

| | | | | |
|---|---|---|---|---|
| 6,220,592 | B1 | 4/2001 | Watanabe et al. | |
| 7,260,354 | B2 * | 8/2007 | Ishida | G03G 15/2064 399/407 |
| 7,579,130 | B2 * | 8/2009 | Kobayashi | G03G 15/6591 428/447 |
| 7,817,953 | B2 * | 10/2010 | Ishibashi | B65H 45/14 156/227 |
| 11,360,416 | B2 * | 6/2022 | Yamaguchi | G03G 15/6573 |
| 2007/0164505 | A1 * | 7/2007 | Ishibashi | B65H 7/02 271/226 |
| 2013/0051886 | A1 * | 2/2013 | Watanabe | G03G 15/6544 399/409 |
| 2021/0191297 | A1 * | 6/2021 | Yamaguchi | G03G 15/6544 |
| 2022/0035261 | A1 * | 2/2022 | Shimano | G03G 9/135 |

(Continued)

FOREIGN PATENT DOCUMENTS

| | | |
|---|---|---|
| JP | 2007-193004 A | 8/2007 |
| JP | 2008-162029 A | 7/2008 |

(Continued)

*Primary Examiner* — Leslie A Nicholson, III
(74) *Attorney, Agent, or Firm* — Venable LLP

(57) ABSTRACT

A sheet bonding apparatus includes an electrophotographic unit configured to apply powder adhesive on a sheet by an electrophotographic process, a folding portion configured to fold the sheet on which the powder adhesive has been applied by the electrophotographic unit, and a bonding portion configured to heat the sheet folded by the folding portion to bond the sheet by the powder adhesive, wherein the bonding portion and the folding portion are disposed over the electrophotographic unit.

15 Claims, 13 Drawing Sheets

(56) References Cited

U.S. PATENT DOCUMENTS

| | | | | |
|---|---|---|---|---|
| 2022/0035288 | A1* | 2/2022 | Matsuda | B65H 45/142 |
| 2022/0035296 | A1* | 2/2022 | Nishizawa | B65H 31/02 |

FOREIGN PATENT DOCUMENTS

| | | | |
|---|---|---|---|
| JP | 2008-173917 | A | 7/2008 |
| JP | 2008-178985 | A | 8/2008 |
| JP | 2008-181027 | A | 8/2008 |

* cited by examiner

SHEET BONDING APPARATUS

BACKGROUND OF THE INVENTION

Field of the Invention

The present disclosure relates to a sheet bonding apparatus that bonds a sheet by powder adhesive by using an electrophotographic system.

Description of the Related Art

Conventionally, an image forming apparatus that, in the case of producing a document including a confidential content and needs to be sealed, such as a payment slip or a pressure-bonded postcard, outputs a product in which confidential information is sealed by an electrophotographic system using printing toner and powder adhesive is proposed as described in Japanese Patent Laid-Open Nos. 2007-193004 and 2008-162029. In this apparatus, printing (transfer) of information using printing toner and application (transfer) of powder adhesive on a bonding-planned region are performed on a sheet, then a bonding (sealing) process is performed by performing a fixing process on the sheet, folding the sheet, and further heating and pressurizing the sheet.

In recent years, accompanied by development of personal computers and printers and rise of the sense of personal information protection, a demand for easy production of a small lot of payment slips or pressure-bonded postcards has increased in small business sites and personal offices. However, if both the information printing function and the sheet bonding (sealing) function are provided in one apparatus as in the image forming apparatus of the document described above, the apparatus becomes large and expensive. Such a large apparatus occupies a large area in the office or the like where the apparatus is installed, and also the installation cost thereof is high. Therefore, a sheet bonding apparatus that is small and of a low cost has been desired.

In addition, when the temperature of the apparatus body of the sheet bonding apparatus is raised by heat discharged from a heating device for the bonding process, the state of powder adhesive accommodated in the apparatus body changes due to the heat, and sufficient adhesion cannot be obtained in the bonding process in some cases. In addition, in the case of reducing the size of the sheet bonding apparatus, reducing increase in the temperature of the powder adhesive caused by heat from a bonding device and a fixing device serving as heat sources has been desired.

SUMMARY OF THE INVENTION

The present invention provides a sheet bonding apparatus capable of realizing miniaturization of the apparatus or reduction of the temperature rise of the powder adhesive.

According to one aspect of the invention, a sheet bonding apparatus includes an electrophotographic unit configured to apply powder adhesive on a sheet by an electrophotographic process, a folding portion configured to fold the sheet on which the powder adhesive has been applied by the electrophotographic unit, and a bonding portion configured to heat the sheet folded by the folding portion to bond the sheet by the powder adhesive, wherein the bonding portion and the folding portion are disposed over the electrophotographic unit.

According to another aspect of the invention, a sheet bonding apparatus includes an electrophotographic unit configured to apply powder adhesive on a sheet by an electrophotographic process, a folding portion configured to fold the sheet on which the powder adhesive has been applied by the electrophotographic unit, a bonding portion configured to heat the sheet folded by the folding portion to bond the sheet by the powder adhesive, and a discharge tray onto which the sheet bonded by the bonding portion is discharged, wherein the discharge tray is disposed above a space in the electrophotographic unit where the powder adhesive is accommodated.

According to still another aspect of the invention, a sheet bonding apparatus includes an electrophotographic unit including a powder accommodating portion that accommodates powder adhesive and configured to apply the powder adhesive on a sheet, a folding portion configured to fold the sheet on which the powder adhesive has been applied by the electrophotographic unit, and a bonding portion configured to heat the sheet folded by the folding portion to bond the sheet by the powder adhesive, wherein a bottom portion of the powder accommodating portion is positioned below a lower end portion of the bonding portion in a vertical direction.

Further features of the present invention will become apparent from the following description of exemplary embodiments with reference to the attached drawings.

DESCRIPTION OF THE EMBODIMENTS

Embodiments of the present disclosure will be described below with reference to drawings.

First Embodiment

Overall Apparatus Configuration

Figure 1:
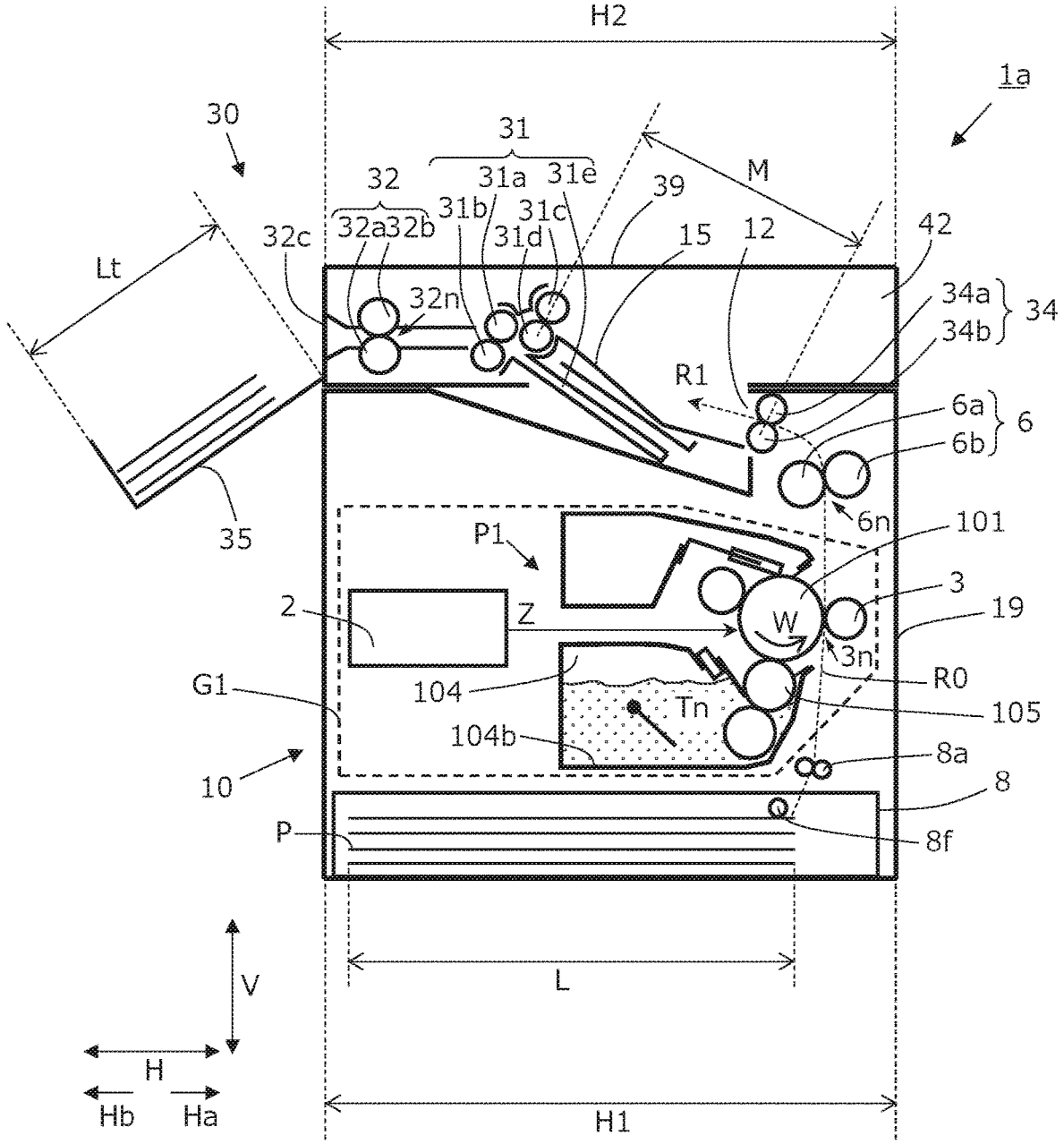
FIG. 1 is a schematic view of a sheet bonding apparatus according to a first embodiment.

First, an overall configuration of a sheet bonding apparatus 1*a* will be described with reference to FIG. 1. FIG. 1 is a schematic diagram illustrating a sectional configuration of the sheet bonding apparatus 1*a* including a sheet bonding apparatus body (hereinafter referred to as an apparatus body 10) according to the first embodiment, and a post-processing unit 30 connected to the apparatus body 10. The sheet bonding apparatus 1*a* is constituted by the apparatus body 10 including a powder adhesive application mechanism of an electrophotographic system, and the post-processing unit 30 serving as a sheet processing apparatus. As will be described below, the apparatus body 10 includes a similar configuration to an image forming apparatus of an electrophotographic system except that powder adhesive is used as developer.

First, an internal configuration of the apparatus body 10 will be described. As illustrated in FIG. 1, the apparatus body 10 includes a sheet cassette 8 serving as a sheet accommodating portion that accommodates a sheet P to be bonded, an electrophotographic unit G1 that applies powder adhesive on the sheet P, a fixing device 6 serving as a fixing portion and a first heating device, and a casing 19 that accommodates these. The apparatus body 10 has a function of applying powder adhesive Tn by the electrophotographic unit G1 on the sheet P fed from the sheet cassette 8 and performing a fixing process of fixing the powder adhesive Tn to the sheet P by the fixing device 6. Here, as the sheet P, a pre-printed sheet on which information has been printed in advance by an any one of various printing systems such as an electrophotographic system, an inkjet system, and offset printing is set. The sheet bonding apparatus 1*a* of the present embodiment is an apparatus that manufactures a product obtained by applying only the powder adhesive Tn on the pre-printed sheet and bonding the pre-printed sheet, and can be also referred to as a pressure-bonding apparatus.

The electrophotographic unit G1 of the present embodiment is mainly used for applying the powder adhesive Tn for bonding the sheet P. That is, the sheet bonding apparatus 1*a* does not include an image forming portion that forms an image on the sheet by an electrophotographic system or a different system. In addition, although an attachment portion (attachment space) for attaching the electrophotographic unit G1 is provided on the casing 19 of the sheet bonding apparatus 1*a*, only one electrophotographic unit G1 can be attached to the attachment portion, and a space for attaching a different electrophotographic unit is not provided. Therefore, the sheet bonding apparatus 1*a* can be configured to be smaller and of a lower cost than in a configuration in which both an electrophotographic unit for forming an image, that is, for printing information on a sheet, and an electrophotographic unit for applying powder adhesive on the sheet are both provided in one apparatus.

The sheet cassette 8 is inserted in a lower portion of the apparatus body 10 such that the sheet cassette 8 can be pulled out from the casing 19, and accommodates a plurality of sheets P. The sheets P accommodated in the sheet cassette 8 are fed one by one from the sheet cassette 8 by a feeding roller 8*f* in a state of being separated from each other by an unillustrated separation roller pair, and are conveyed by a conveyance roller 8*a*. The feeding roller 8*f* is an example of a feeding member that feeds the sheet P, and for example, a feeding mechanism that attracts the sheet P by suction on the surface of an endless belt in which air holes are formed, by a negative pressure generated by an air suction unit may be used. The separation roller pair includes a conveyance roller that conveys the sheet P, and a separation roller that is supported by a fixed shaft via a torque limiter and abuts the conveyance roller. The separation roller applies a frictional force to the sheet in a nip portion between the conveyance roller and the separation roller serving as a separation nip, and thus sheets other than the sheet P in contact with the conveyance roller are prevented from being fed together. To be noted, the mechanism that separates the sheet P is not limited to the separation roller, and for example, a friction member of a pad shape may be used.

The electrophotographic unit G1 is an electrophotographic mechanism including a process cartridge P1, a scanner unit 2, and a transfer roller 3. The electrophotographic unit G1 functions as an adhesive application unit that applies the powder adhesive on the sheet P by an electrophotographic process using the powder adhesive as a developer. The process cartridge is a unit of a plurality of parts that perform the electrophotographic process and is configured such that the plurality of parts can be collectively replaced. The apparatus body 10 is provided with an unillustrated cartridge support portion that is supported by the casing 19, and the process cartridge P1 is detachably attached to the apparatus body 10.

The process cartridge P1 includes a photosensitive member unit CC including a photosensitive drum 101 serving as an image bearing member and the like, and a developing unit DT including a powder accommodating portion 104, a developing roller 105 that performs development using a powder, and the like. Details will be described below. To be noted, in the present disclosure, the term "development" is used for referring to not only a process of visualizing an electrostatic latent image on an image bearing member by using printing toner that is a color toner, but also a process of attaching the powder adhesive Tn that is transparent to the electrostatic latent image on the image bearing member. The powder accommodating portion 104 accommodates the powder adhesive Tn that is a powder for performing a bonding process of the sheet P that also serves as a bonding toner.

The scanner unit 2 functions as an exposing portion that irradiates the photosensitive drum 101 of the process cartridge P1 with laser light Z to draw an electrostatic latent image. The transfer roller 3 opposes the photosensitive drum 101 of the process cartridge P1, and forms a transfer nip 3*n* serving as a transfer portion together with the photosensitive drum 101. The transfer roller 3 functions as a transfer portion that transfers the powder adhesive Tn from the photosensitive drum 101 onto the sheet P fed from the sheet cassette 8 in the transfer nip 3*n*.

The fixing device 6 is disposed above the transfer roller 3. The fixing device 6 is a fixing unit of a thermal fixation system including a heating roller 6*a* serving as a fixing member and a pressurizing roller 6*b* serving as a pressurizing member. The heating roller 6*a* is heated by a heat generation member such as a halogen lamp or a ceramic heater, or a heat generation mechanism of an induction heating system. The pressurizing roller 6*b* is pressed against the heating roller 6*a* by an urging member such as a spring, and generates a pressurizing force for pressurizing the sheet P passing through a fixing nip 6*n* that is a nip portion between the heating roller 6*a* and the pressurizing roller 6*b*. To be noted, although a configuration in which a roller pair serving as a rotary member pair nips and conveys the sheet has been described as an example here, for example, a fixing unit of a thermal film system may be used as the fixing device 6. A fixing unit of a thermal film system includes a cylindrical film having a heater including a heat-generating resistor on the inner circumferential surface thereof, and a pressurizing roller that is in pressure contact with the heater with the film therebetween, and nips and conveys the sheet in a nip portion between the pressurizing roller and the film.

The casing 19 is provided with a discharge port 12 that is an opening portion for discharging the sheet P from the apparatus body 10, and a discharge unit 34 is disposed in the discharge port 12. The discharge unit 34 serving as a discharge portion of the present embodiment includes a first discharge roller 34*a* and a second discharge roller 34*b*.

In addition, a conveyance path including the conveyance roller 8*a*, the transfer nip 3*n*, and the fixing nip 6*n* in the apparatus body 10 constitutes a main conveyance path R0 in which the powder adhesive Tn is applied on, that is, transferred onto the sheet P. The main conveyance path R0 extends from the lower side to the upper side through one side in the horizontal direction H with respect to the electrophotographic unit G1 as viewed in a main scanning direction of the electrophotographic process. Here, the main scanning direction is a rotation axis direction of the photosensitive drum 101, and is also a sheet width direction perpendicular to a conveyance direction of the sheet P conveyed in the main conveyance path R0. In other words, the apparatus body 10 of the present embodiment is an electrophotographic apparatus of a so-called vertical conveyance type (vertical path type) in which the main conveyance path R0 extends in approximately the vertical direction V. To be noted, when viewed in the vertical direction V, an intermediate path 15 whose details will be described below, and the sheet cassette 8 at least partially overlap with each other. Therefore, the movement direction of the sheet P in the horizontal direction H when the discharge unit 34 discharges the sheet P is opposite to the movement direction of the sheet P in the horizontal direction H when the sheet P is fed from the sheet cassette 8.

Post-Processing Unit

As illustrated in FIG. 1, the post-processing unit 30 is mounted on top of the apparatus body 10. In the post-processing unit 30, a folder 31 serving as a folding portion and a bonding device 32 serving as a bonding portion and a first heating device are accommodated and integrated in a casing 39. In addition, the post-processing unit 30 includes the intermediate path 15 and a first discharge tray 35. Functions of portions included in the post-processing unit 30 will be described below.

As described above, in the present embodiment, the folder 31 serving as a folding portion and the bonding device 32 serving as a bonding portion are disposed over the electrophotographic unit G1. The electrophotographic unit G1 that is an electrophotographic unit includes at least an image bearing member, a charging portion, an exposing portion, a developing portion, and a transfer portion. Therefore, in a sheet bonding apparatus that applies powder adhesive by using an electrophotographic system, a relatively large space above the electrophotographic unit G1 can be used for accommodating the bonding device 32 serving as a heating device and the folder 31. As a result of this, the sheet bonding apparatus can be miniaturized. To be noted, the miniaturization of the sheet bonding apparatus in the present disclosure refers to reduction of the occupation range, that is, reduction of the projection area of the sheet bonding apparatus in top view unless otherwise described. In addition, disposing the folder 31 and the bonding device 32 over the electrophotographic unit G1 refers to disposing the folder 31 and the bonding device 32 such that at least one of the folder 31 and the bonding device 32 at least partially overlaps the electrophotographic unit G1 as viewed in the vertical direction.

In addition, in the present embodiment, the powder adhesive Tn applied by the electrophotographic unit G1 is (provisionally) fixed to the sheet by the fixing device 6 serving as a first heating device, and then the sheet is bonded by the bonding device 32 serving as a second heating device different from the first heating device. Here, since the fixing device 6 and the bonding device 32 are disposed over the electrophotographic unit G1, the sheet bonding apparatus having a configuration including two heating devices can be miniaturized.

Further, from the viewpoint of FIG. 1, that is, as viewed in the main scanning direction of the electrophotographic process, an occupation range H2 of a unit portion 42 of the post-processing unit 30 excluding the first discharge tray 35, that is, the folder 31 and the bonding device 32 in the horizontal direction H is within the occupation range H1 of the apparatus body 10. In other words, in the present embodiment, a second casing is provided within an occupation range of a first casing as viewed in the vertical direction. As described above, by accommodating the post-processing unit 30 within a space over the apparatus body 10, the sheet bonding apparatus 1*a* having a bonding function can be installed in an installation space of approximately the same size as a normal small electrophotographic image forming apparatus of a vertical path type.

In addition, the bonding device 32 serving as a heating device is disposed above the electrophotographic unit G1 including a powder accommodating portion 104 serving as an accommodating portion. Therefore, air heated by the bonding device 32 is less likely to reach the powder accommodating portion 104, and thus change of state of the powder adhesive Tn caused by temperature rise derived from the heat of the bonding device 32 can be reduced. That is, in the present embodiment, as a result of the configuration in which the folder 31 and the bonding device 32 are disposed over the electrophotographic unit G1, miniaturization of the sheet bonding apparatus 1*a* and reduction of the temperature rise of the powder adhesive Tn can be achieved simultaneously.

Particularly, in the present embodiment, whereas the powder accommodating portion 104 is accommodated in the casing 19 of the apparatus body 10 serving as a first casing, the bonding device 32 is accommodated in the casing 39 of the post-processing unit 30 serving as a second casing. The inner space of the casing 19 of the apparatus body 10 and the inner space of the casing 39 of the post-processing unit 30 are substantially partitioned from each other by a casing wall of at least one of the casings 19 and 39 except for the discharge port 12 where the sheet P is passed from one to the other. Therefore, the air heated by the bonding device 32 is even less likely to reach the powder accommodating portion 104, and change of the state of the powder adhesive Tn caused by temperature rise derived from the heat of the bonding device 32 can be reduced more effectively. To be noted, in the case where the temperature rise of the powder adhesive Tn is within an allowable range, the bonding device 32 and the folder 31 may be disposed in the casing 19 shared with the electrophotographic unit G1.

In addition, in the present embodiment, a conveyance path of an inverse C shape extending on the three sides, that is, the lower side, the right side in FIG. 1, and the upper side of the electrophotographic unit G1 from the viewpoint of FIG. 1 is formed as a conveyance path for outputting a bonded product that will be described below while conveying the sheet P. That is, the sheet P accommodated in a space below the electrophotographic unit G1 is delivered out to a first side in the horizontal direction H, which is the right side in FIG. 1, by the feeding roller 8*f* In addition, the sheet P having passed through the fixing device 6 is conveyed to a second side in the horizontal direction H, which is the left side in FIG. 1, by the discharge unit 34 serving as a conveyance member. In such a configuration, the fixing device 6 is disposed on the main conveyance path R0 that is a sheet conveyance path extending from the feeding roller 8*f* toward the discharge unit 34 on the first side in the horizontal direction H, which is the side in an arrow Ha direction, with respect to the electrophotographic unit G1. In addition, the bonding device 32 is disposed on a sheet conveyance path extending in the second side in the horizontal direction H, which is the side in an arrow Hb direction, from the discharge unit 34 via the folder 31 on the upper side of the electrophotographic unit G1.

As described above, by configuring a conveyance path of an inverse C shape and disposing the fixing device 6, the folder 31, the bonding device 32, and the like on the conveyance path, the sheet bonding apparatus 1*a* can be sufficiently miniaturized, and a specific configuration can be realized. To be noted, the configuration is not limited to the conveyance path of the inverse C shape, and as a modification example, for example, a conveyance path of an S shape may be configured. In the case of the conveyance path of an S shape, a sheet is fed toward a first side in the horizontal direction from a cassette or the like, transfer is performed while the sheet is conveyed toward a second side in the horizontal direction via a turning point of the conveyance path, and the sheet is discharged to the first side in the horizontal direction via a turning point of the conveyance path again.

Here, how providing a conveyance path of an inverse C shape in the apparatus body 10 is advantageous for reduction of the temperature rise of the powder adhesive Tn because providing the powder accommodating portion 104 in a lower portion of the electrophotographic unit G1 is natural will be described. In the case of the conveyance path of the inverse C shape, the rotation direction of the photosensitive drum 101 is set to a counterclockwise direction in FIG. 1 such that the surface of the photosensitive drum 101 moves upward, which is the conveyance direction of the sheet P, in the transfer nip 3*n*. In this case, since the cleaning position, the charging position, the exposing position, and the developing position are arranged in this order from the transfer nip 3*n* toward the downstream side in the rotation direction of the photosensitive drum 101, the developing position is normally lower than the rotation axis of the photosensitive drum 101. Therefore, if a conveyance path of an inverse C shape is employed, it is easier to dispose the powder accommodating portion 104 in a lower portion of the electrophotographic unit G1 to secure a distance (particularly, distance in the vertical direction) from the fixing device 6 and the bonding device 32 to the powder accommodating portion 104. In contrast, if a conveyance path of an S shape is employed, the electrophotographic unit is disposed above the conveyance path where transfer onto the sheet is performed, and therefore the distance (particularly, distance in the vertical direction) from the fixing device 6 and the bonding device 32 to the powder accommodating portion 104 is difficult to secure in some cases. Therefore, by providing the conveyance path of the inverse C shape, the temperature rise of the powder adhesive Tn in the powder accommodating portion 104 can be easily reduced.

As a result of the configuration described above, according to the present embodiment, miniaturization of the sheet bonding apparatus 1*a* and reduction of the temperature rise of the powder adhesive Tn can be achieved simultaneously.

Figure 2:
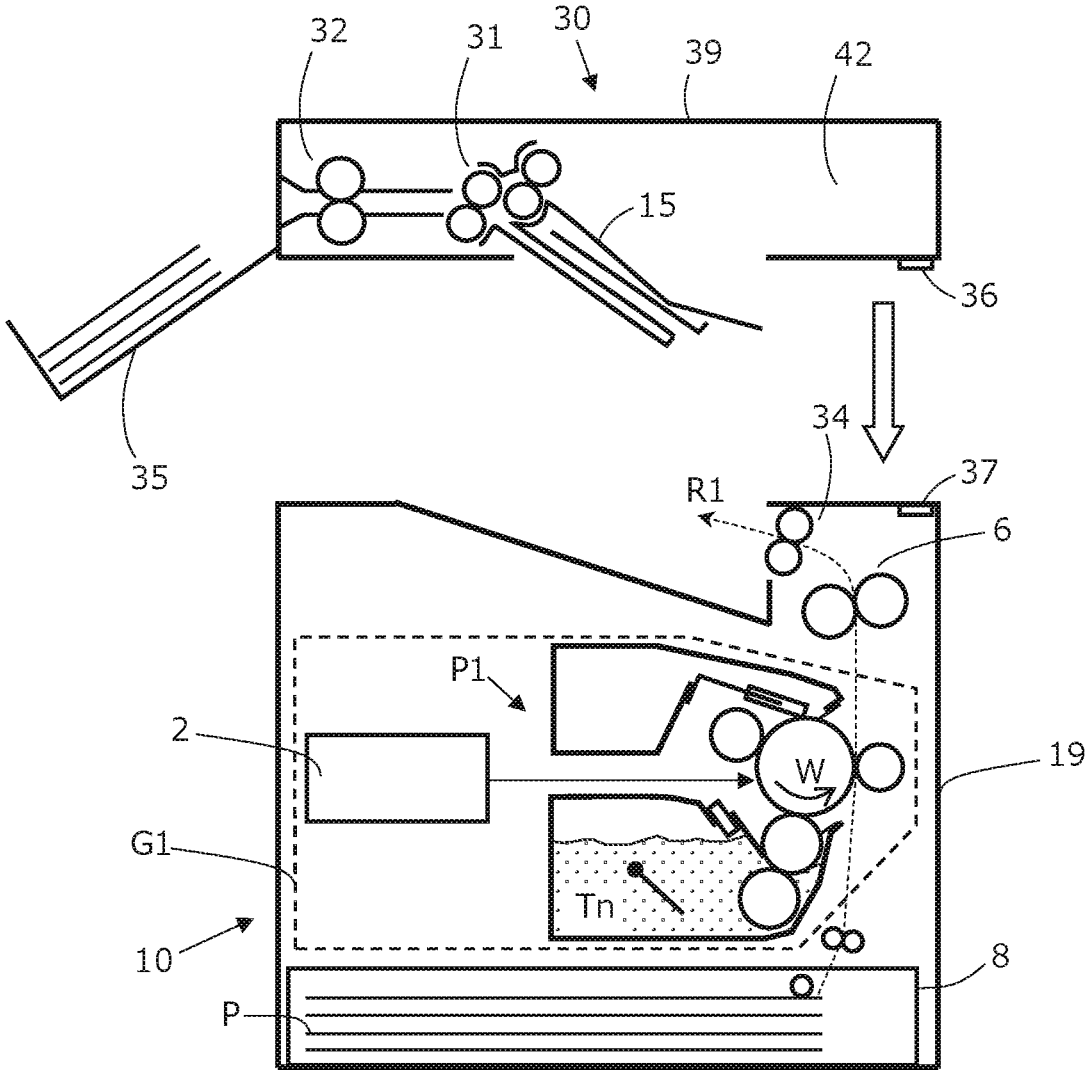
FIG. 2 is a diagram for describing attachment of a post-processing unit to an apparatus body of the sheet bonding apparatus according to the first embodiment.

In addition, as illustrated in FIG. 2, the post-processing unit 30 is provided with a positioning portion for positioning the casing 39 with respect to the casing 19 of the apparatus body 10. The positioning portion is not illustrated, and is, for example, a projection shape that fits in a recess portion of the casing 19. In addition, the post-processing unit 30 is provided with an unillustrated drive source and an unillustrated controller that are different from those of the apparatus body 10 and are electrically connected to the apparatus body 10 as a result of a connector 36 of the post-processing unit 30 connecting to a connector 37 of the apparatus body 10. As a result of this, the post-processing unit 30 is in a state in which the post-processing unit 30 operates on the basis of a command from a controller provided in the apparatus body 10 on a power supplied via the apparatus body 10.

Process Cartridge

Figure 3A:
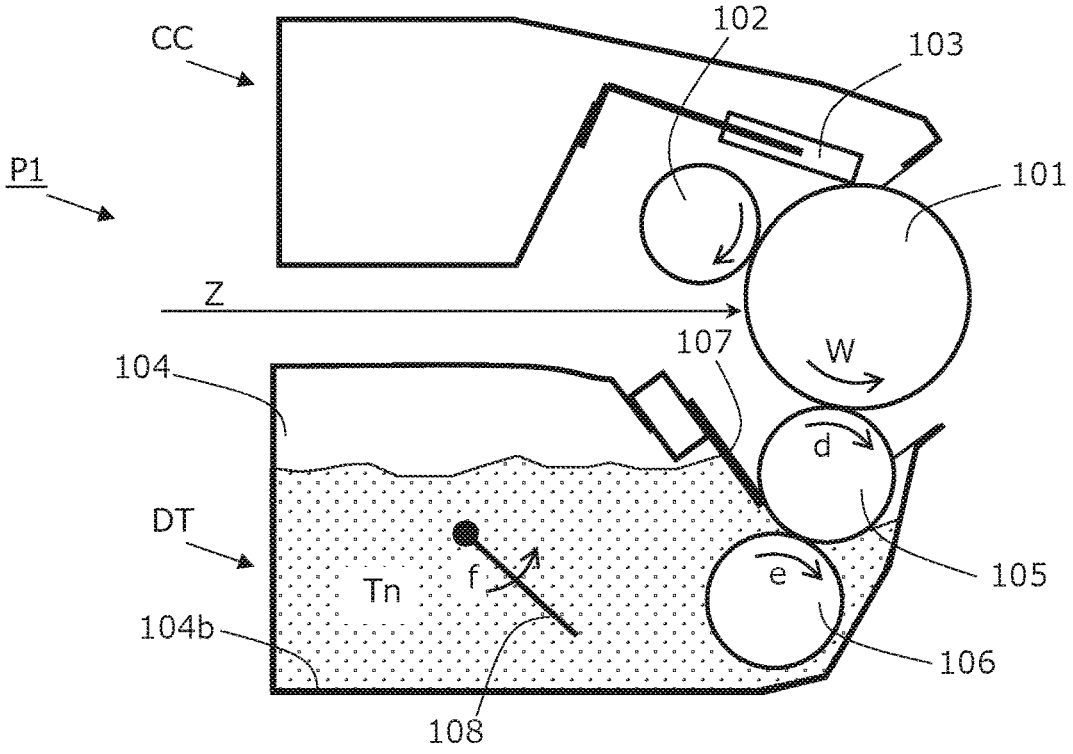
FIGS. 3A and 3B are each a schematic view of a process cartridge according to the first embodiment.

Details of the process cartridge P1 will be described. FIG. 3A is a section view of the process cartridge P1 illustrating a schematic configuration thereof. The process cartridge P1 includes a photosensitive member unit CC including the photosensitive drum 101 and the like, and a developing unit DT including the developing roller 105 and the like.

The photosensitive drum 101 that is an electrophotographic photosensitive member formed in a drum shape is rotatably attached to the photosensitive member unit CC via an unillustrated bearing. In addition, the photosensitive drum 101 receives a driving force of a motor serving as an unillustrated driving portion or a drive source provided in the apparatus body 10, and is thus rotationally driven in a counterclockwise direction that is indicated by an arrow w in FIG. 3A, in the electrophotographic process. Further, in the photosensitive member unit CC, a charging roller 102 serving as a charting portion that charges the photosensitive drum 101, and a cleaning member 103 serving as a cleaning portion that cleans the surface of the photosensitive drum 101 are disposed around the photosensitive drum 101.

The developing unit DT is provided with the developing roller 105 serving as a developer bearing member that rotates in the clockwise direction that is indicated by an arrow d in FIG. 3A, in contact with the photosensitive drum 101. The developing roller 105 and the photosensitive drum 101 respectively rotate such that the surfaces thereof move in the same direction in an opposing portion or a contact portion therebetween. The developing roller 105 functions as a developing portion that develops the electrostatic latent image on the photosensitive drum 101 by using the powder adhesive Tn that is a developer.

In addition, a developer supply roller serving as a developer supply member that rotates in the clockwise direction indicated by an arrow e in FIG. 3A is disposed in the developing unit DT. Hereinafter, the developer supply roller will be simply referred to as a "supply roller 106". The supply roller 106 and the developing roller 105 respectively rotate such that the surfaces thereof move in opposite directions in an opposing portion or contact portion therebetween. The supply roller 106 supplies the powder adhesive Tn onto the developing roller 105. At the same time, the supply roller 106 has an effect of peeling off the powder adhesive Tn remaining on the developing roller 105 from the developing roller 105. In addition, a developing blade 107 serving as a developer regulating member that regulates the layer thickness of the powder adhesive Tn supplied onto the developing roller 105 by the supply roller 106 is disposed in the developing unit DT.

The powder accommodating portion 104 accommodates the powder adhesive Tn as powder. In addition, a conveyance member 108 that is rotatably supported is provided in the powder accommodating portion 104. The conveyance member 108 rotates in the counterclockwise direction that is indicated by an arrow f in FIG. 3A to agitate the powder adhesive Tn accommodated in the powder accommodating portion 104, and conveys the powder adhesive Tn to the developing roller 105 and the supply roller 106.

Here, the photosensitive member unit CC and the developing unit DT may be configured as separate members, that is, a photosensitive member unit cartridge and a developing unit cartridge such that the photosensitive member unit CC and the developing unit DT are attachable to and detachable from the apparatus body 10. In addition, the powder accommodating portion 104 and the conveyance member 108 may be configured as a powder cartridge attachable to and detachable from the apparatus body 10 separately from a process cartridge including a photosensitive member and a developer bearing member.

Powder Adhesive

As the powder adhesive Tn of the present embodiment, a powder containing thermoplastic resin can be used. The thermoplastic resin is not particularly limited, and examples thereof include known thermoplastic resins such as polyester resin, vinyl-based resin, acrylic resin, styrene-acrylic resin, polyethylene, polypropylene, polyolefin, ethylene-vinyl acetate copolymer resin, and ethylene-acrylic acid copolymer resin. A plurality of these resins may be contained.

In addition, the powder adhesive Tn preferably further contains wax. As the wax, known waxes such as ester wax that is ester of alcohol and acid, and hydrocarbon wax such as paraffin wax can be used.

In addition, the powder adhesive Tn may contain a colorant. As this colorant, known colorants such as black colorant, yellow colorant, magenta colorant, and cyan colorant can be used. The content of the colorant in the powder adhesive is preferably 1.0 mass % or less, and more preferably 0.1 mass % or less. Further, the powder adhesive Tn may contain a magnetic body, a charge control agent, and an external additive.

To form a bonding region serving as a bonding portion for the powder adhesive Tn on the sheet P by using an electrophotographic system, the weight average particle diameter of the powder adhesive Tn is preferably 5.0 μm or more and 30 μm or less, and more preferably 6.0 μm or more and 20 μm or less. To be noted, printing toner may be used as the powder adhesive Tn as long as an adhesive property is satisfied.

Manufacture Example of Powder Adhesive

An example of a manufacturing method for the powder adhesive Tn will be described below. First, the following materials were prepared Styrene: 75.0 parts n-butyl acrylate: 25.0 parts polyester resin (polyester resin having a weight average molecular weight Mw of 20,000, a glass transition temperature Tg of 75° C., and an acid value of 8.2 mgKOH/g): 4.0 parts ethylene glycol distearate (ester wax obtained by esterifying ethylene glycol and stearic acid): 14.0 parts hydrocarbon wax (HNP-9 manufactured by Nippon Seiro Co., Ltd.): 2.0 parts divinylbenzene: 0.5 parts A mixture of the materials described above were maintained at 60° C., stirred at 500 rpm by using a T. K. homomixer (manufactured by Tokushu Kika Kogyo Co., Ltd.) to uniformly dissolve the materials, and thus a polymerizable monomer composition was prepared.

Meanwhile, 850.0 parts of a 0.10 mol/L-$Na_3PO_4$ aquatic solution and 8.0 parts of 10% hydrochloric acid were charged into a container including a high-speed stirring device CLEARMIX manufactured by M Technique Co., Ltd., the rotation speed was adjusted to 15,000 rpm, and the temperature was raised to 70° C. 127.5 parts of a 1.0 mol/L-$CaCl_2$ aquatic solution was added to this, and thus an aquatic medium containing a calcium phosphate compound was prepared.

The polymerizable monomer composition was charged into the aquatic medium, then 7.0 parts of t-butyl peroxypivalate that was a polymerization initiator was added thereto, and granulation was performed for 10 minutes while maintaining the rotation speed at 15,000 rpm. Thereafter, the stirrer was switched from the high-speed stirrer to a propeller stirring blade, the mixture was left to react for 5 hours at 70° C. while being circulated, then the liquid temperature was raised to 85° C., and the mixture was further left to react for 2 hours.

After the polymerization reaction was finished, a resulting slurry was cooled, further hydrochloric acid was added to the slurry to adjust the pH to 1.4, and the slurry was stirred for 1 hour to dissolve the calcium phosphate salt. Then, the slurry was washed by water of an amount that was triple the amount of the slurry, and was filtered and dried, and was then classified to obtain powder adhesive particles.

Thereafter, 2.0 parts of silica fine particles (number average particle diameter of primary particles: 10 nm, BET specific surface area: 170 $m^2/g$) hydrophobized by using dimethyl silicone oil (20 mass %) were added as an external additive to 100.0 parts of the powder adhesive particles. Then, the powder adhesive particles to which the silica fine particles had been added was mixed for 15 minutes at 3,000 rpm by using Mitsui Henschel mixer (manufactured by Mitsuimitsuike Kakoki) to obtain the powder adhesive Tn. The weight average particle diameter of the obtained powder adhesive Tn was 6.8 μm.

Measurement Method for Weight Average Particle Diameter

The weight average particle diameter of the powder adhesive Tn is calculated as follows. As the measurement apparatus, a fine particle size distribution measurement apparatus "Coulter counter Multisizer 3 (registered trademark, manufactured by Beckman Coulter)" including a 100-μm aperture tube and using an orifice electric resistance method is used. Dedicated software "Beckman Coulter Multisizer 3 Version 3.51 (manufactured by Beckman Coulter)" that is an accessory for the apparatus is used for setting the measurement conditions and analyzing the measurement data. To be noted, the measurement is performed at an effective measurement channel number of 25 thousand channels.

As an electrolyte aquatic solution used for measurement, an aquatic solution of special grade sodium chloride dissolved in ion exchange water to a content of 1 mass %, for example, "ISOTON II (manufactured by Beckman Coulter)" can be used.

To be noted, before performing measurement and analysis, setting of the dedicated software is performed as follows. In the "change the standard measurement method (SOM)" screen of the dedicated software, the total count number of the control mode is set to 50,000 particles, the number of times of the measurement is set to 1, and the Kd value is set to a value obtained by using "standard particles 10.0 μm (manufactured by Beckman Coulter)". By pressing "measurement button for threshold value/noise level", the threshold value and the noise level are automatically set. In addition, the current is set to 1600 μA, the gain is set to 2, and the electrolyte solution is set to ISOTON II, and a checkbox for "flushing aperture tube after measurement" is checked. In the "setting of conversion from pulse to particle diameter" screen of the dedicated software, the bin interval is set to a logarithmic particle diameter, the particle diameter bins are set to 256 particle diameter bins, and the particle diameter range is set to 2 μm to 60 μm.

The specific measurement method is as follows.

(1) 200 mL of an electrolyte aquatic solution is charged in a 250 mL round-bottom beaker formed from glass and dedicated to Multisizer 3, the beaker is set in a sample stand, and is stirred by a stirrer rod at 24 rps in a counterclockwise direction. Then, dirt and bubbles in the aperture tube are removed by the "flushing the aperture tube" function of the dedicated software.

(2) 30 mL of an electrolyte aquatic solution is charged in a 100 mL flat-bottom beaker formed from glass. 0.3 mL of "Contaminon N (10 mass % aquatic solution of neutral detergent for washing fine measurement devices having a pH of 7, which is constituted by nonionic surfactant, anionic surfactant, and organic builder, manufactured by Wako Pure Chemical Industries)" diluted to triple the mass by ion exchange water is added to this as a dispersant.

(3) An ultrasonic disperser "Ultrasonic Dispersion System Tetora 150 (manufactured by Nikkaki Bios)" including two oscillators of an oscillation frequency of 50 kHz whose phases are different from each other by 180° and having an electric output of 120 W is prepared. 3.3 L of ion exchange water is charged in a water chamber of the ultrasonic disperser, and 2 mL of Contaminon N is added to this water chamber.

(4) The beaker of (2) described above is set in a beaker fixing hole of the ultrasonic disperser described above, and the ultrasonic disperser is caused to operate. Then, the height position of the beaker is adjusted such that the resonance state of the liquid surface of the electrolyte aquatic solution in the beaker is maximized.

(5) In a state in which the electrolyte aquatic solution in the beaker of (4) described above is irradiated with an ultrasonic wave, the powder adhesive Tn is added to the electrolyte aquatic solution little by little to reach 10 mg, and is thus dispersed. Then, the ultrasonic dispersion process is continued further for 60 seconds. To be noted, in the ultrasonic dispersion, the water temperature of the water chamber is appropriately adjusted to remain within the range of 10° C. to 40° C.

(6) The electrolyte aquatic solution of (5) described above in which the powder adhesive Tn is dispersed is dripped into the round-bottom beaker of (1) described above set in the sample stand by using a pipette such that the measurement concentration is adjusted to 5%. Then, the measurement is performed until the number of measured particles reaches 50,000.

(7) The measurement data is analyzed by the dedicated software attached to the apparatus, and thus the weight average particle diameter is calculated.

Sheet Bonding Operation

Next, a sheet bonding operation performed by the sheet bonding apparatus 1*a* of the present embodiment will be described with reference to FIGS. 1, 3A, 4A to 4F, and 5A to 5C. FIGS. 4A to 4F are diagrams for describing the details of a folding process. FIGS. 5A to 5C are diagrams illustrating examples of bonded products output by the sheet bonding apparatus 1*a*.

In the case of manufacturing a product such as a pressure-bonded postcard or a payment slip by using the sheet bonding apparatus 1*a* of the present embodiment, a pre-printed sheet on which information has been printed in advance is first set as the sheet P in the sheet cassette 8. At this time, the sheet P is set such that the bonding surface of the sheet P faces upward, that is, toward the upper side of the apparatus.

First, data of an application pattern of the powder adhesive Tn to be printed and an execution command of the sheet bonding operation are input to the sheet bonding apparatus 1*a* from an external personal computer or the like. The controller of the sheet bonding apparatus 1*a* starts a series of operations for applying the powder adhesive Tn on the sheet P in accordance with a designated application pattern while the sheet P is conveyed, and performing a folding process and a bonding process in the post-processing unit 30. This series of operations will be collectively referred to as a sheet bonding operation. In the sheet bonding operation, first, as illustrated in FIG. 1, the sheets P are fed from the sheet cassette 8 one by one, and conveyed toward the transfer nip 3*n* via the conveyance roller 8*a*.

In parallel with the feeding of the sheet P, the photosensitive drum 101 of the process cartridge P1 is rotationally driven in a counterclockwise direction indicated by an arrow win FIG. 1. The surface of the photosensitive drum 101 is uniformly charged by the charging roller 102. In addition, the scanner unit 2 irradiates the photosensitive drum 101 of the process cartridge P1 with the laser light Z based on the application pattern, and thus forms an electrostatic latent image on the surface of the photosensitive drum 101. Next, the electrostatic latent image on the photosensitive drum 101 is developed as powder adhesive Tn image with the powder adhesive Tn borne on the developing roller 105 of the process cartridge P1. That is, the powder adhesive Tn attaches to a region on the surface of the photosensitive drum 101 corresponding to the application pattern where the powder adhesive Tn is applied on the sheet P.

The powder adhesive Tn image formed on the photosensitive drum 101 is transferred onto the sheet P in the transfer nip 3*n* between the photosensitive drum 101 and the transfer roller 3. Thus, the powder adhesive Tn is applied on, that is, transferred onto the sheet P by the electrophotographic unit G1.

Then, the sheet P is conveyed to the fixing device 6 and receives a thermal fixation process. That is, the powder adhesive Tn image on the sheet P is heated and pressurized when the sheet P passes through the fixing nip 6*n*, thus the powder adhesive Tn melts and then adheres to be fixed to the pre-printed surface of the sheet P. Fixation of the powder adhesive Tn refers to a state in which the particles of the powder adhesive Tn borne on the sheet P by electrostatic force after transfer melts by being heated and pressurized and then adheres, and thus the powder adhesive Tn is not easily peeled off from the surface of the sheet P even when a mechanical external force is applied thereto.

The sheet P discharged from the apparatus body 10 is nipped by the first discharge roller 34*a* and the second discharge roller 34*b*, and is conveyed from the discharge port 12 to the first path R1.

An intermediate path 15 is provided between the fixing device 6 and the folder 31 in the first path R1. The intermediate path 15 is a sheet conveyance path positioned in the middle between the apparatus body 10 and the post-processing unit 30. To be noted, the intermediate path 15 is inclined upward in the vertical direction V toward the folder 31 with respect to the horizontal direction H. Therefore, a first guide roller 31*c* and a second guide roller 31*d* that serve as an entrance to the folder 31 are positioned above the first discharge roller 34*a* and the second discharge roller 34*b* serving as an exit from the apparatus body 10 in the vertical direction.

The folder 31 includes four rollers including the first guide roller 31*c*, the second guide roller 31*d*, a first folding roller 31*a*, and a second folding roller 31*b*, and a pull-in portion 31*e*. The first guide roller 31*c* and the second guide roller 31*d* are a guide roller pair that nips and conveys the sheet P received from a conveyance path upstream of the folder 31, which is the intermediate path 15 in the present embodiment. The first folding roller 31*a* and the second folding roller 31*b* are a folding roller pair that delivers out the sheet P while folding the sheet P.

To be noted, a distance M from the first discharge roller 34*a* to the first guide roller 31*c* in a conveyance direction of the sheet P along the first path R1 is configured to be smaller than the total length L of the sheet P in the conveyance direction before the folding process. In other words, the distance M from the first discharge roller 34*a* to the first guide roller 31*c* determines the lower limit of the length in the conveyance direction of the sheet P that can be processed by the post-processing unit 30. According to this configuration, the sheet P is smoothly passed onto the guide roller pair from the discharge unit 34.

FIGS. 4A to 4F each illustrate a step of the folding process of the sheet P performed by the folder 31. As a result of performing the folding process by the folder 31, the folding process is executed such that the surface on which the powder adhesive Tn is on the inside, that is, such that the surface faces itself when folded.

Figure 4A:
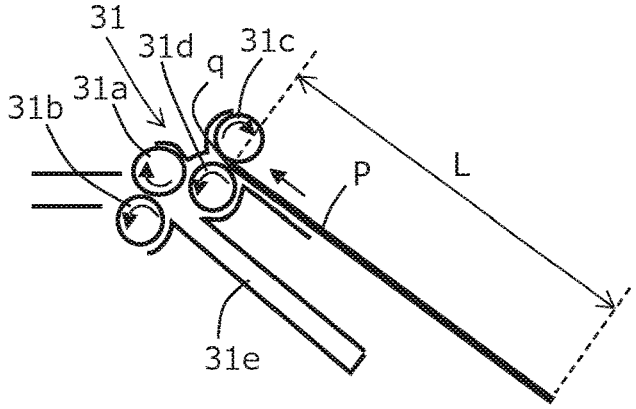
FIGS. 4A to 4F are each a diagram for describing details of a folding process according to the first embodiment.
Figure 4B:
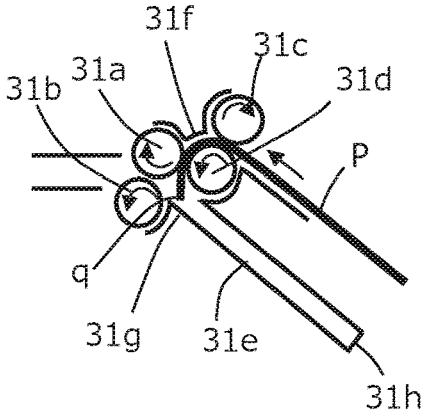
Figure 5A:
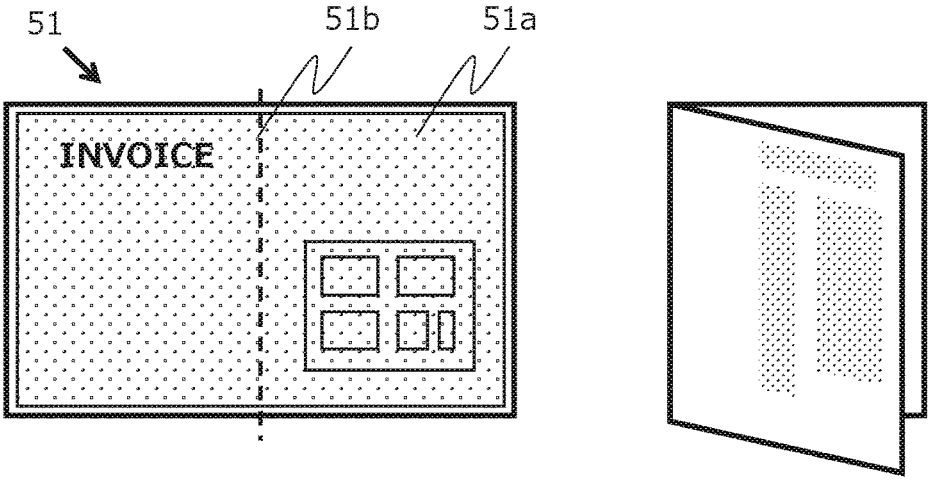
FIGS. 5A to 5C are each a diagram illustrating an example of a bonded product output by the sheet bonding apparatus according to the first embodiment.
Figure 5B:
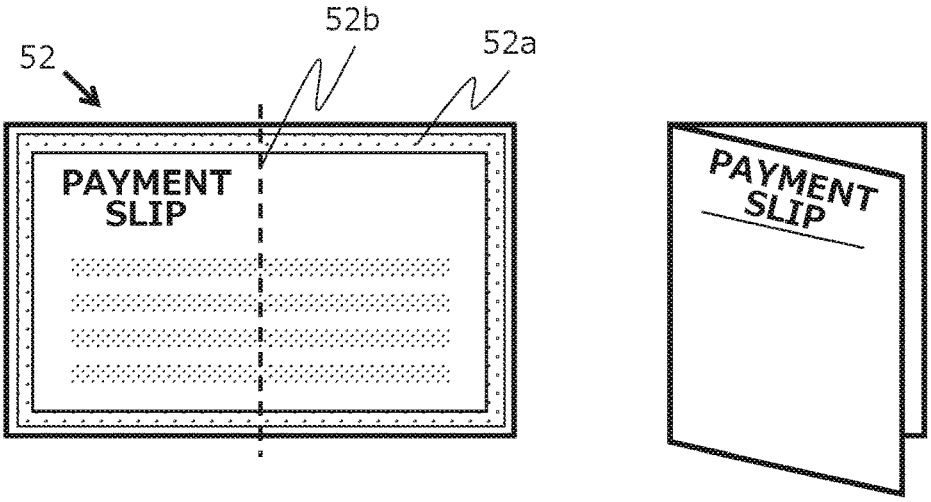
Figure 5C:
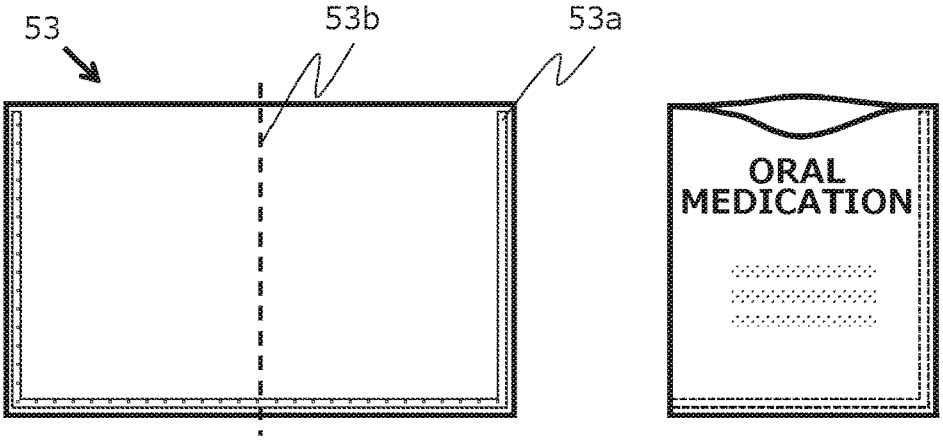

In the case of performing the folding process, as illustrated in FIG. 4A, the first guide roller 31*c* and the first folding roller 31*a* rotate in the clockwise direction in FIG. 4A, and the second guide roller 31*d* and the second folding roller 31*b* rotate in the counterclockwise direction in FIG. 4A. First, a leading end q of the sheet P delivered out from the discharge unit 34 is pulled in by the guide roller pair constituted by the guide rollers 31*c* and 31*d*. As illustrated in FIG. 4B, the leading end q of the sheet P is guided downward by a guide wall 31*f*, and comes into contact with the first folding roller 31*a*. Then, the leading end q is pulled in by the first folding roller 31*a* and the second guide roller 31*d* opposing each other, and abuts a wall 31*g* of the pull-in portion 31*e*.

As the pull-in of the sheet P by the guide roller pair including the guide rollers 31*c* and 31*d* progresses, the leading end q advances deeper in the pull-in portion 31*e* while sliding on the wall 31*g*. Eventually, the leading end q abuts an end portion 31*h* of the pull-in portion 31*e* as illustrated in FIG. 4C. To be noted, the pull-in portion 31*e* defines a space extending approximately parallel to the intermediate path 15 on the lower side of the intermediate path 15 as illustrated in FIG. 1. Then, at the stage of FIG. 4C, the sheet P is wrapped around the second guide roller 31*d* and bent into a U shape.

Figure 4D:
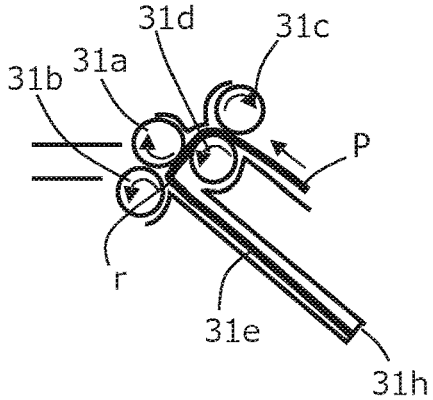
Figure 4E:
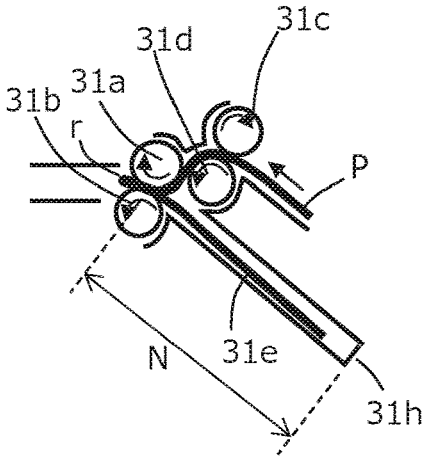
Figure 4C:
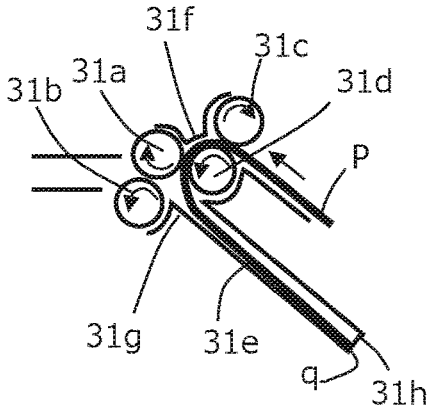
Figure 4F:
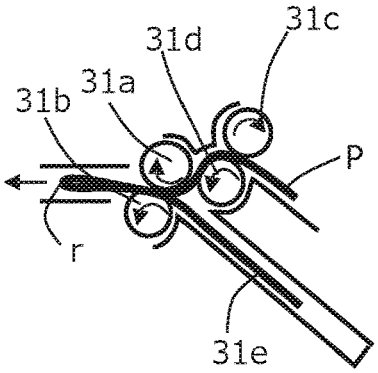

When the sheet P is further pulled in by the guide roller pair of the guide rollers 31*c* and 31*d* from the state of FIG. 4C, a middle portion r thereof starts warping as illustrated in FIG. 4D. Eventually, as illustrated in FIG. 4E, the middle portion r comes into contact with the second folding roller 31*b*, and is thus pulled into a nip portion between the folding roller pair constituted by the folding rollers 31*a* and 31*b* by a frictional force received from the second folding roller 31*b*. Then, as illustrated in FIG. 4F, the sheet P is discharged by the folding roller pair in a state in which the sheet P is folded at the middle portion r as the folding line and the leading end. Here, in the present embodiment, a depth N of the pull-in portion 31*e* illustrated in FIG. 4E, that is, a distance between the nip portion of the folding roller pair of the folding rollers 31*a* and 31*b* and the end portion 31*h* of the pull-in portion 31*e* is set to a half of the total length L of the sheet P. As a result of this, the folder 31 can execute a process of folding the sheet P to a half-length, that is, middle folding. To be noted, by changing the depth N of the pull-in portion 31*e*, the position of the folding line can be changed flexibly.

The folder 31 described above is an example of a folding portion, and for example, a folding mechanism that forms the folding line by pushing a blade against the sheet P and pushing the sheet P into a nip portion of the roller pair may be used. In addition, the folding process is not limited to folding in half, and for example, a folding mechanism that folds the sheet P in a Z shape or folding the sheet P in third may be used. To be noted, since the folder 31 of the present embodiment is constituted by a rotating roller and the fixed pull-in portion 31*e*, the drive mechanism thereof can be simplified as compared with a folding mechanism including a reciprocating blade. In addition, since the folder 31 of the present embodiment only includes the pull-in portion 31*e* having the depth N that is half the length L of the sheet P in addition to the four rollers, the post-processing unit 30 can be miniaturized.

As illustrated in FIG. 1, the sheet P having passed through the folder 31 is conveyed to the bonding device 32. The bonding device 32 has a configuration of a thermal fixation system similarly to the fixing device 6. That is, the bonding device 32 includes a heating roller 32*b* serving as a heating member and a pressurizing roller 32*a* serving as a pressurizing member. The heating roller 32*b* is heated by a heat generation member such as a halogen lamp or a ceramic heater, or a heat generation mechanism of an induction heating system. The pressurizing roller 32*a* is pressed against the heating roller 32*b* by an urging member such as a spring, and generates a pressurizing force for pressurizing the sheet P passing through a bonding nip that is a nip portion between the heating roller 32*b* and the pressurizing roller 32*a*. To be noted, although a configuration in which a roller pair serving as a rotary member pair nips and conveys the sheet has been described as an example here, for example, a fixing unit of a thermal film system similarly to the fixing device 6 may be used as the bonding device 32.

The sheet P folded by the folder 31 receives a bonding process, that is, second thermal fixation on the powder adhesive Tn by the bonding device 32, and is thus bonded in the state of being folded. That is, when the sheet P passes through the bonding nip 32*n*, the powder adhesive Tn on the sheet P is heated, and is pressurized in a re-softened state. As a result of this, the powder adhesive Tn on the bonding surface, that is, the surface on which the powder adhesive Tn is applied and faces itself in the folded state, comes in firm contact with each other. Then, the powder adhesive Tn is cooled and solidified, and thus the sheet P is bonded (pressure-bonded) by using the powder adhesive Tn as an adhesive.

The sheet having undergone the bonding process by the bonding device 32 is discharged to the left side in FIG. 1 from the discharge port 32*c* provided in the casing 39 of the post-processing unit 30. Then, the sheet P is accommodated in a first discharge tray 35 provided on a left side surface of the apparatus body 10.

The first discharge tray 35 is disposed above a space in the electrophotographic unit G1 where the powder adhesive Tn is accommodated, that is, the inner space of the powder accommodating portion 104. Therefore, the heat of the product discharged onto the first discharge tray 35 is less likely to be transmitted to the powder accommodating portion 104 in the apparatus body 10, and therefore the temperature rise of the powder adhesive Tn caused by the transmission of heat from the product can be reduced. In addition, in the present embodiment, the first discharge tray 35 is disposed so as to project from the casing 39 of the post-processing unit 30 in a state in which the first discharge tray 35 overhangs to the outside of the occupation range H1 of the apparatus body 10 in the horizontal direction H. Therefore, the transmission of the heat from the product discharged onto the first discharge tray 35 to the powder accommodating portion 104 in the apparatus body 10 can be further reduced.

Here, a length Lt of the first discharge tray 35 in the sheet conveyance direction is smaller than the length L of the sheet P. That is, the length Lt of the first discharge tray 35 is smaller than the largest length (i.e., length of a largest sheet) in the sheet conveyance direction of the sheet P on which the sheet bonding apparatus 1*a* can perform the folding process and the bonding process, that is, smaller than a maximum sheet length Lm. This is because a bonded product whose length in the sheet conveyance direction has been reduced to a value smaller than the sheet length Lm as a result of the folding process is discharged onto the first discharge tray 35. Also according to such a configuration, the sheet bonding apparatus 1*a* can be miniaturized.

By performing the operation described above, the powder adhesive Tn can be applied on the sheet P, the sheet P can be folded and bonded by the post-processing unit 30, and thus the bonded product can be manufactured.

To be noted, the bonding region, that is, a bonded position of the folded sheet P can be changed in accordance with the application pattern of the powder adhesive Tn on the sheet P. FIGS. 5A to 5C illustrate examples of bonded products, that is, products output from the sheet bonding apparatus whose application patterns of the powder adhesive Tn are different. FIGS. 5A and 5B illustrate examples of bonded products that are to be opened by the recipient of the products, that is, half-bonded products. In the case of a pressure-bonded postcard 51 of FIG. 5A, the powder adhesive Tn is applied on an entire surface 51*a* of one side of an original sheet, and the sheet is bonded in the state of being folded at a folding line 51*b* at the center. In the case of a payment slip 52 of FIG. 5B, the powder adhesive Tn is applied on an entire periphery 52*a* of the outer peripheral portion of one side of the original sheet, and the sheet is bonded in the state of being folded at a folding line 52*b* at the center. FIG. 5C illustrates a bag (medicine bag) as an example of a bonded product (fully-bonded product) whose application is not based on being opened. In this case, the powder adhesive Tn is applied on a U-shaped region 53*a* such that two sides of the sheet in the folded state other than a folding line 53*b* are bonded, and the sheet is bonded in a state in which the sheet is folded at the folding line 53*b* at the center.

Storage Temperature of Powder Adhesive

Incidentally, when the sheet bonding apparatus 1*a* illustrated in FIG. 1 executes the sheet bonding operation, power is supplied to the fixing device 6 and the bonding device 32 to execute the thermal fixation process and the bonding process, and thus the fixing device 6 and the bonding device 32 generate heat. In addition, the process cartridge P1 generates heat by friction or the like between the developing roller 105 and the photosensitive drum 101. Further, a power unit generates heat when supplying power to electric members related to the electrophotographic process such as the transfer roller 3 and the charging roller 102.

When the temperature of the powder adhesive Tn accommodated in the sheet bonding apparatus 1*a* rises due to the heat generated by heat sources such as the fixing device 6 and the bonding device 32, change in the state of the powder adhesive Tn such as melting or aggregation of the adhesive particles can occur. The powder adhesive Tn typically has a melting point and a glass transition temperature that are lower than those of printing toner used for normal printing, such that the bonding function is more easily exerted, and are thus easily softened or melted. Therefore, the temperature of the powder adhesive Tn that is stored needs to be carefully controlled. When the state of the powder adhesive Tn changes, there is a possibility that output of a normal bonded product in the bonding process is hindered by, for example, occurrence of a bonding failure caused by insufficient application of the powder adhesive Tn.

In the sheet bonding apparatus 1 of the present embodiment, the powder accommodating portion 104 accommodating the powder adhesive Tn is disposed below the fixing device 6 and the bonding device 32 in the vertical direction V as illustrated in FIG. 1. Specifically, a bottom portion 104*b* of the powder accommodating portion 104 is positioned below a lower end portion of the fixing device 6 and a lower end portion of the bonding device 32. To be noted, the lower end portion of the fixing unit refers to the bottom surface of a casing of the fixing unit accommodating the heating roller and the pressurizing roller. If there is no member corresponding to this, the lower end portion of the fixing unit refers to a lower end portion of the heating roller serving as a heat source. More preferably, the powder accommodating portion 104 is disposed such that the whole of the powder accommodating portion 104 is positioned below the lower end portion of the fixing device 6 and the lower end portion of the bonding device 32.

In addition, in the present embodiment, the entrance to the folder 31 is provided above the discharge unit 34 serving as an exit from the apparatus body 10 as illustrated in FIG. 1. In addition, the occupation range of the folder 31 and the occupation range of the bonding device 32 in the vertical direction V overlap, and the sheet conveyance path from the folder 31 to the bonding device 32 extends approximately in the horizontal direction H. That is, since the bonding device 32 is positioned above the discharge unit 34, the bonding device 32 serving as a heat source is separated upward from the powder accommodating portion 104 of the powder adhesive Tn.

As described above, in the present embodiment, the bonding device 32 that is necessary for the bonding process and also serves as a heat source is disposed above the electrophotographic unit G1 including the powder accommodating portion 104. As a result of this, transmission of heat to the powder accommodating portion 104 via air heated by the bonding device 32 can be reduced, the temperature rise of the powder adhesive Tn in the powder accommodating portion 104 can be reduced, and change in the state of the powder adhesive Tn can be reduced.

In addition, in the present embodiment, both the fixing device 6 and the bonding device 32 serving as two heating devices that are heat sources are disposed above the electrophotographic unit G1. According to such a configuration, transmission of heat to the powder accommodating portion 104 via air heated by the fixing device 6 or the bonding device 32 can be reduced, and therefore the temperature rise of the powder adhesive Tn in the powder accommodating portion 104 can be effectively reduced. In a similar reason, in the present embodiment, the powder accommodating portion 104 is disposed below both the fixing device 6 and the bonding device 32.

First Modification Example

In the first embodiment, a sheet bonding apparatus to which the process cartridge P1 accommodating the powder adhesive Tn is attached and which manufactures a bonded product that is bonded has been described as the sheet bonding apparatus 1*a*. The process cartridge P1 is the only electrophotographic unit that the sheet bonding apparatus 1*a* includes, and the sheet bonding apparatus 1*a* does not include an electrophotographic unit for forming an image for recording text information or a photograph on a sheet by using printing toner. However, the process cartridge P1 accommodating the powder adhesive Tn may be detached from the sheet bonding apparatus 1*a*, and a process cartridge P2 accommodating printing toner Tk instead may be attached to perform normal printing.

The process cartridge P1 accommodating the powder adhesive Tn is an example of a first cartridge, and the process cartridge P2 accommodating the printing toner Tk is an example of a second cartridge. To be noted, in the present modification example, description will be given assuming that the entirety of the process cartridge including the photosensitive member unit CC and the developing unit DT is replaced. The configuration is not limited to this, and a configuration in which only the developing unit DT serving as a developing cartridge unit accommodating the powder adhesive Tn or the printing toner Tk is replaced may be employed.

Figure 6A:
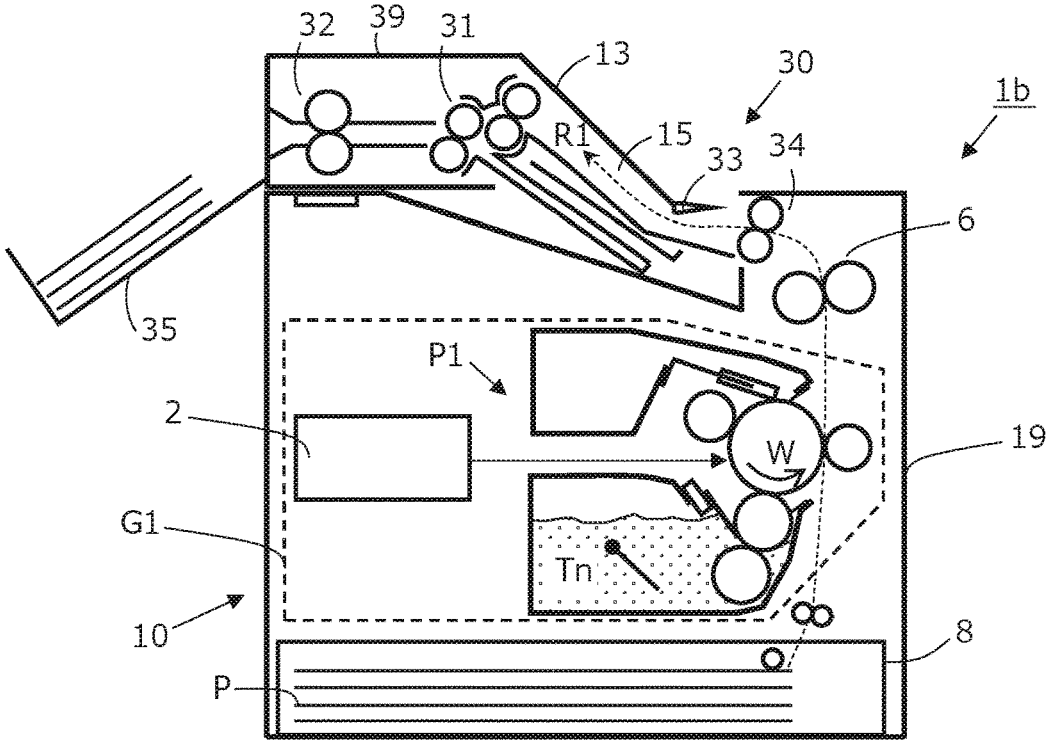
FIGS. 6A and 6B are each a schematic view of a multi-purpose apparatus according to a first modification example.
Figure 6B:
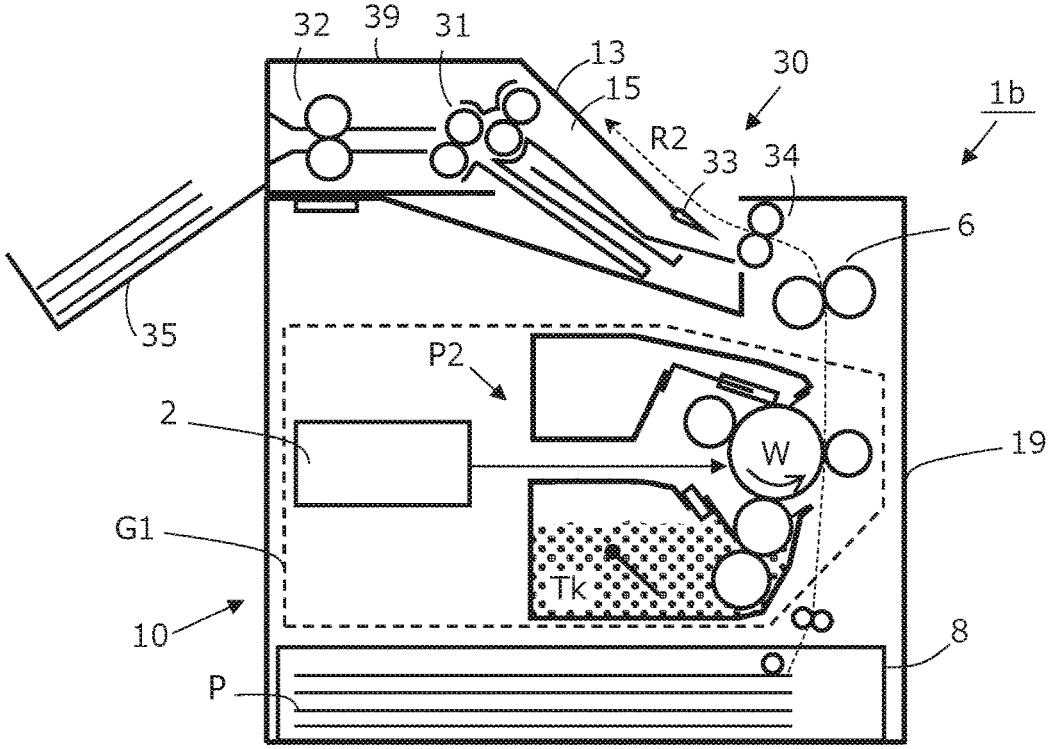

FIGS. 6A and 6B illustrate a multi-purpose apparatus 1*b* that uses the process cartridge P1 accommodating the powder adhesive Tn and the process cartridge P2 accommodating the printing toner Tk while switching therebetween. That is, the multi-purpose apparatus 1*b* can switch between a use mode as a sheet bonding apparatus illustrated in FIG. 6A, and a use mode as an image forming apparatus illustrated in FIG. 6B by replacing the cartridge. The multi-purpose apparatus 1*b* serving as a sheet bonding apparatus illustrated in FIG. 6A outputs a product obtained by bonding the sheet P that is a pre-printed sheet by the powder adhesive Tn. The multi-purpose apparatus 1*b* serving as an image forming apparatus illustrated in FIG. 6B outputs a product obtained by forming an image on the sheet P serving as a recording material by the printing toner Tk.

As illustrated in FIG. 6B, in the present embodiment, the second discharge tray 13 onto which the sheet P on which printing has been performed by using the printing toner Tk is discharged is provided above the intermediate path 15. A first switching guide 33 is a guide member for switching the sheet P discharged from the discharge unit 34 to the first path R1 or the second path R2. As illustrated in FIG. 6A, in the case where the process cartridge P1 accommodating the powder adhesive Tn is attached, the position of the first switching guide 33 is controlled such that the sheet P is discharged onto the first discharge tray 35 via the first path R1. As illustrated in FIG. 6B, in the case where the process cartridge P2 accommodating the printing toner Tk is attached, the position of the first switching guide 33 is controlled such that the sheet P is discharged onto the second discharge tray 13 via the second path R2.

As a result of this, the multi-purpose apparatus 1*b* can be used as the sheet bonding apparatus and the image forming apparatus.

At least one of the first discharge tray 35 and the second discharge tray 13 is preferably disposed over the electrophotographic unit G1. In the present modification example, the second discharge tray 13 is positioned over the electrophotographic unit G1. As a result of this, the occupation range of the multi-purpose apparatus 1*b* as viewed in the vertical direction can be reduced and thus the apparatus can be miniaturized.

To be noted, in the case of using the multi-purpose apparatus 1*b* as an image forming apparatus, the post-processing unit 30 may be detached from the apparatus body 10 as illustrated in FIG. 2. In this case, a top surface portion of the apparatus body 10 can be used as a discharge portion or a discharge tray onto which the sheet having undergone image formation is discharged to be supported.

Figure 3B:
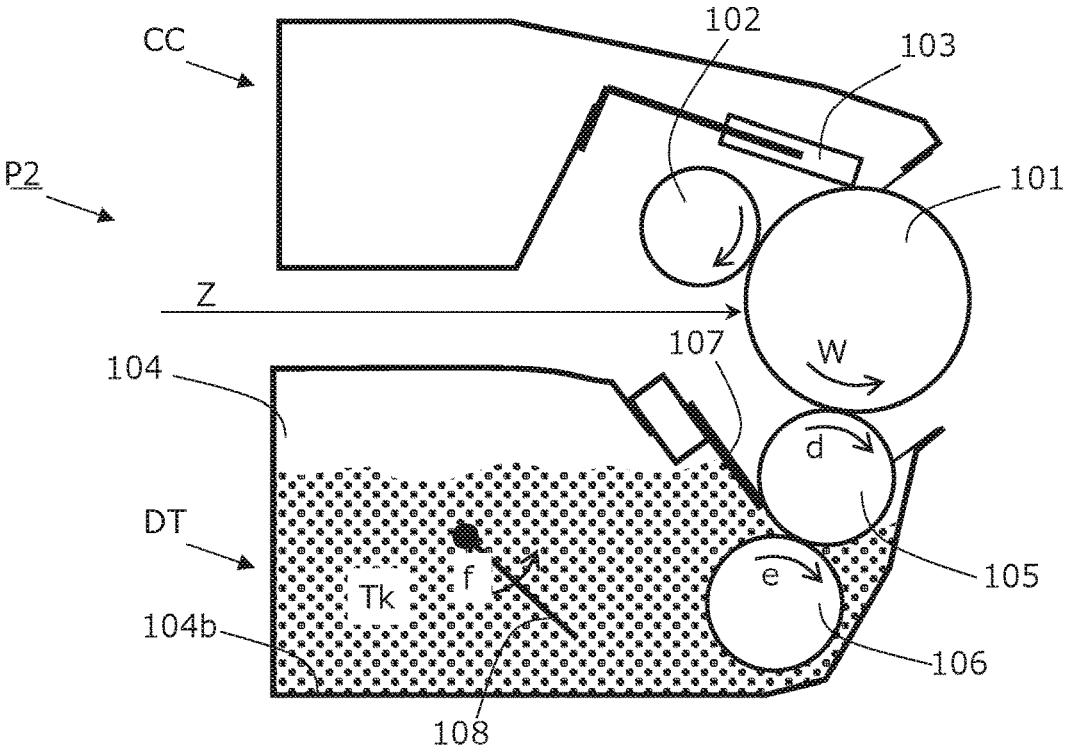

Here, as illustrated in FIG. 3B, the process cartridge P2 accommodating the printing toner Tk is a cartridge in which the powder accommodated in the powder accommodating portion 104 of the process cartridge P1 accommodating the powder adhesive Tn is replaced by the printing toner Tk. The other elements thereof are substantially the same as those of the process cartridge P1 accommodating the powder adhesive Tn.

In addition, for the printing toner Tk, printing toner that is conventionally known can be used. Among these, particularly printing toner including thermoplastic resin as binder resin is preferable. The thermoplastic resin is not particularly limited, and resin that is conventionally used for printing toner, such as polyester resin, vinyl-based resin, acrylic resin, and styrene-acrylic resin, can be used. A plurality of these resins may be contained. Among these, particularly printing toner including styrene-acrylic resin is more preferable. In addition, the printing toner, that is, the printing developer may contain a colorant, a magnetic body, a charge control agent, a wax, and an external additive. In the present embodiment, black printing toner Tk is used as the printing toner.

Second Modification Example

Figure 7A:
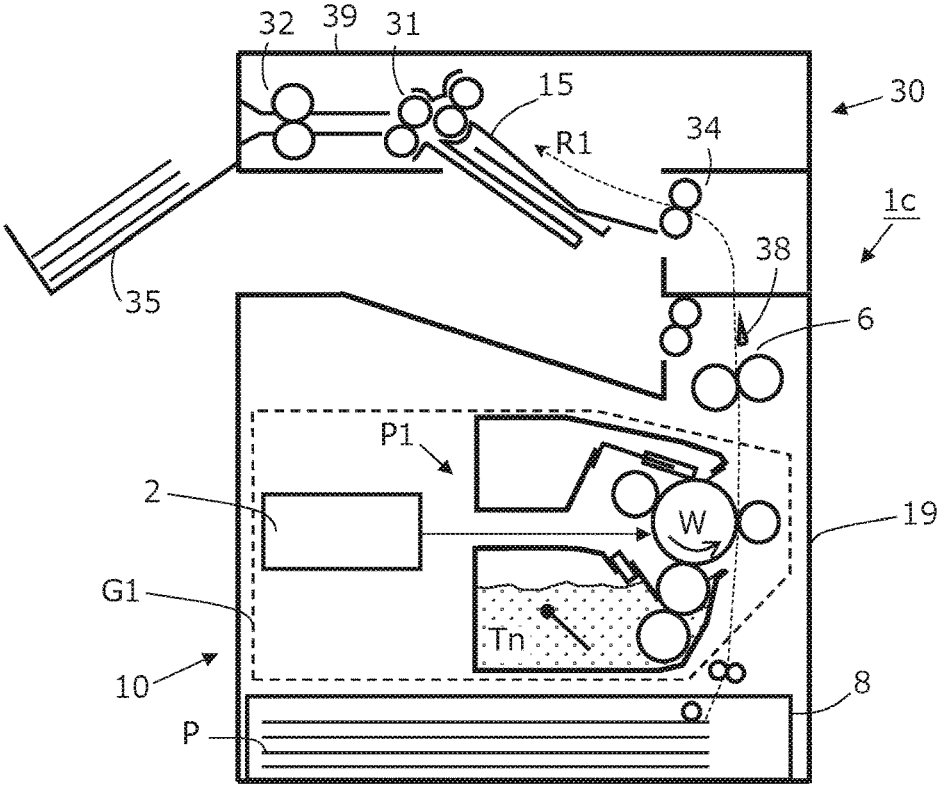
FIGS. 7A and 7B are each a schematic view of a multi-purpose apparatus according to a second modification example.
Figure 7B:
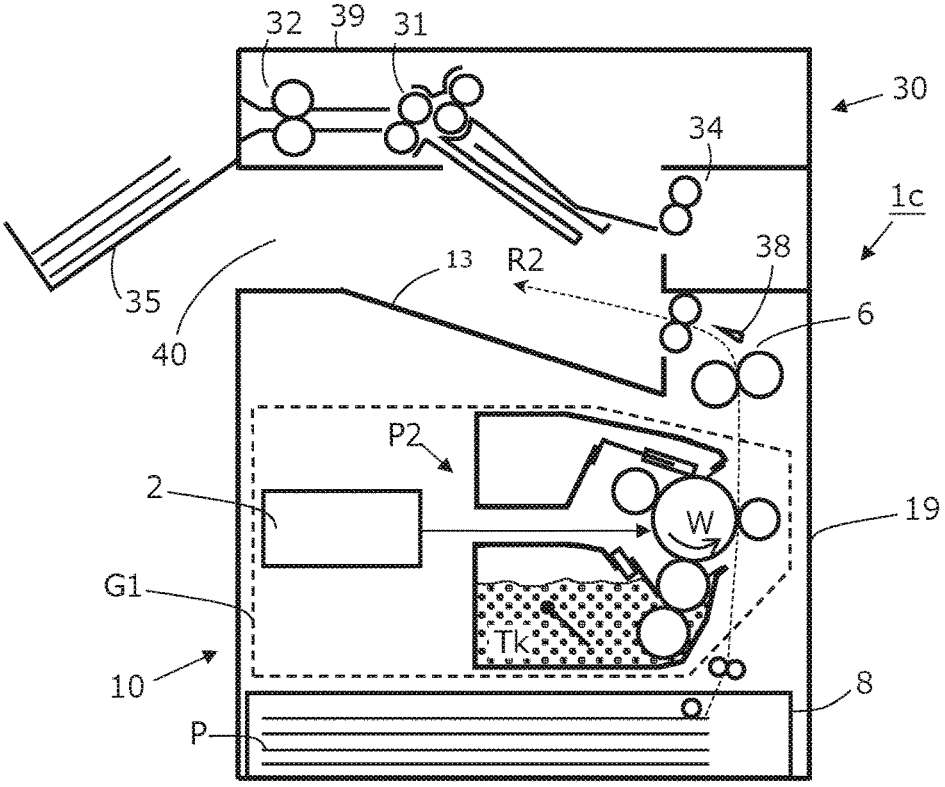

FIGS. 7A and 7B illustrate another example of a multi-purpose apparatus in which the process cartridge P1 accommodating the powder adhesive Tn and the process cartridge P2 accommodating the printing toner Tk can be switched and used. In the present modification example, a space 40 is provided between the apparatus body 10 and the post-processing unit 30, and the second discharge tray 13 is provided in the space 40. The space 40 is a so-called in-body discharge space that is a space between the apparatus body 10 including an electrophotographic unit and the post-processing unit 30 that is an upper unit mounted on top of the apparatus body 10 in the vertical direction.

In this multi-purpose apparatus 1*c*, a second switching guide 38 is provided in the apparatus body 10. The second switching guide 38 is a guide member for switching the sheet P having passed through the fixing device 6 to the first path R1 or the second path R2. As illustrated in FIG. 7A, in the case where the process cartridge P1 accommodating the powder adhesive Tn is attached, the position of the second switching guide 38 is controlled such that the sheet P is discharged onto the first discharge tray 35 via the first path R1. As illustrated in FIG. 7B, in the case where the process cartridge P2 accommodating the printing toner Tk is attached, the position of the second switching guide 38 is controlled such that the sheet P is discharged onto the second discharge tray 13 via the second path R2.

As a result of this, the multi-purpose apparatus 1*c* can be used as the sheet bonding apparatus and the image forming apparatus.

In both the first modification example and the second modification example, the bonding device 32 and the folder 31 are disposed over the electrophotographic unit G1, and thus the sheet bonding apparatus can be miniaturized while reducing the temperature rise of the powder adhesive Tn in the powder accommodating portion 104. In addition, since the powder accommodating portion 104 is disposed below the fixing device 6 and the bonding device 32, the temperature rise of the powder adhesive Tn can be more reliably reduced.

Particularly, in the multi-purpose apparatus 1*c* according to the second modification example, the bonding device 32 serving as a heat source is disposed at a position away from the apparatus body 10 by providing the space 40 between the apparatus body 10 and the post-processing unit 30. By providing the space 40 as described above, the air heated by the bonding device 32 becomes less likely to reach the powder accommodating portion 104 of the process cartridge P1. That is, the space 40 further reduces the temperature rise of the powder adhesive Tn in the powder accommodating portion 104 caused by the heat generated by the bonding device 32.

Also according to the configurations of the modification examples described above, the sheet bonding apparatus can be miniaturized, and the temperature rise of the powder adhesive Tn accommodated in the powder accommodating portion 104 can be reduced.

Second Embodiment

Figure 8:
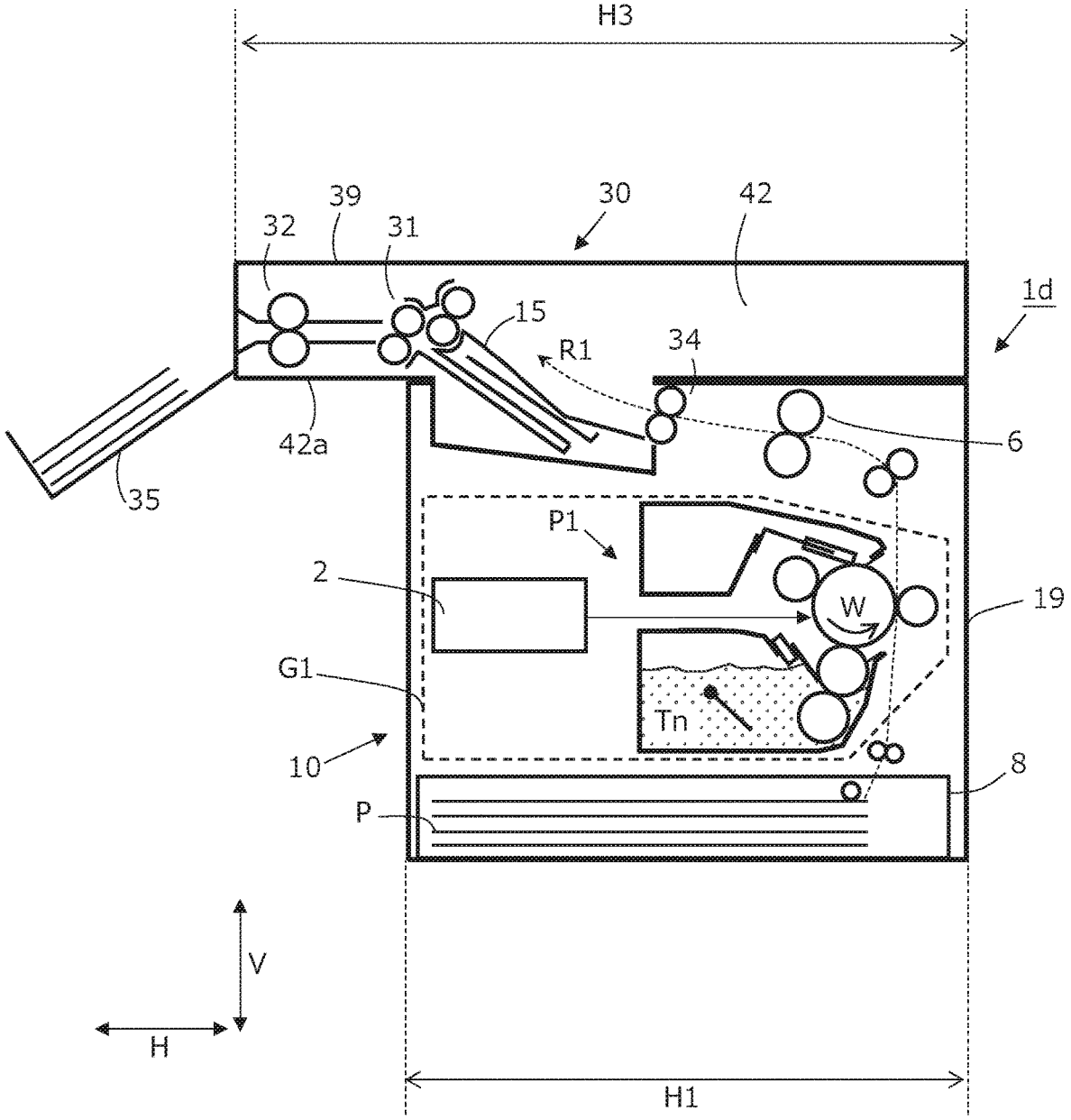
FIG. 8 is a schematic view of a sheet bonding apparatus according to a second embodiment.

FIG. 8 is a schematic diagram illustrating a sectional configuration of a sheet bonding apparatus 1*d* according to the second embodiment. It is assumed that elements denoted by the same reference signs as in the first embodiment have substantially the same configurations and functions as those described in the first embodiment, and elements different from the first embodiment will be mainly described.

In the first embodiment, as illustrated in FIG. 1, the occupation range H2 of the unit portion 42 of the post-processing unit 30 excluding the first discharge tray 35, that is, the folder 31 and the bonding device 32 in the horizontal direction H is within the occupation range H1 of the apparatus body 10. The present embodiment is different from the first embodiment in that an occupation range H3 of the unit portion 42 of the post-processing unit 30 in the horizontal direction H is wider than the occupation range H1 of the apparatus body 10 as illustrated in FIG. 8. That is, the sheet bonding apparatus 1*d* of the present embodiment includes an overhang portion 42*a* where the unit portion 42 of the post-processing unit 30 overhangs with respect to the apparatus body 10 in the horizontal direction H. The overhang portion 42*a* serves as a projection portion, a brim portion, and a stick-out portion.

In addition, at least part of the bonding device 32 is disposed in the casing 39 in the overhang portion 42*a*. It is preferable that, among the bonding device 32, at least the heating roller 32*b* serving as a heating member and the pressurizing roller 32*a* serving as a pressurizing member are disposed in the overhang portion 42*a*, and it is more preferable that the entirety of the bonding device 32 is disposed in the overhang portion 42*a*. To be noted, at least part of the folder 31 is disposed above the electrophotographic unit G1 and within the occupation range H1 of the apparatus body 10 in the horizontal direction H. That is, also in the present embodiment, the bonding device 32 and the folder 31 are disposed over the electrophotographic unit G1.

As described above, in the case where the bonding device 32 is disposed in the overhang portion 42*a*, the post-processing unit 30 does not oppose the apparatus body 10 at a position below the bonding device 32. Therefore, air heated by the bonding device 32 becomes even less likely to reach the powder accommodating portion 104 of the process cartridge P1. Therefore, the temperature rise of the powder adhesive Tn in the powder accommodating portion 104 caused by the heat generated by the bonding device 32 can be further reduced as compared with the first embodiment.

In addition, the lower surface of the overhang portion 42*a* is in contact with the air outside the sheet bonding apparatus 1*d*, and the overhang portion 42*a* is cooled by the outside air. Therefore, the casing 39 of the post-processing unit 30 is more easily cooled around the bonding device 32 than in the first embodiment, and thus the heat is less likely to be transmitted to the apparatus body 10. In addition, as compared with the configuration of the first embodiment, since the casing 39 of the post-processing unit 30 does not oppose the casing 19 of the apparatus body 10 on the lower side of the bonding device 32, heat transmission between the casings is more reduced than in the first embodiment. That is, by disposing the bonding device 32 in the overhang portion 42*a*, the temperature rise of the powder adhesive Tn in the powder accommodating portion 104 caused by the heat generated by the bonding device 32 can be further reduced.

As described above, also in the present embodiment, as a result of disposing the bonding device 32 and the folder 31 over the electrophotographic unit G1, the temperature rise of the powder adhesive Tn in the powder accommodating portion 104 can be reduced while enabling the miniaturization of the sheet bonding apparatus 1*d*.

Third Modification Example

Figure 9:
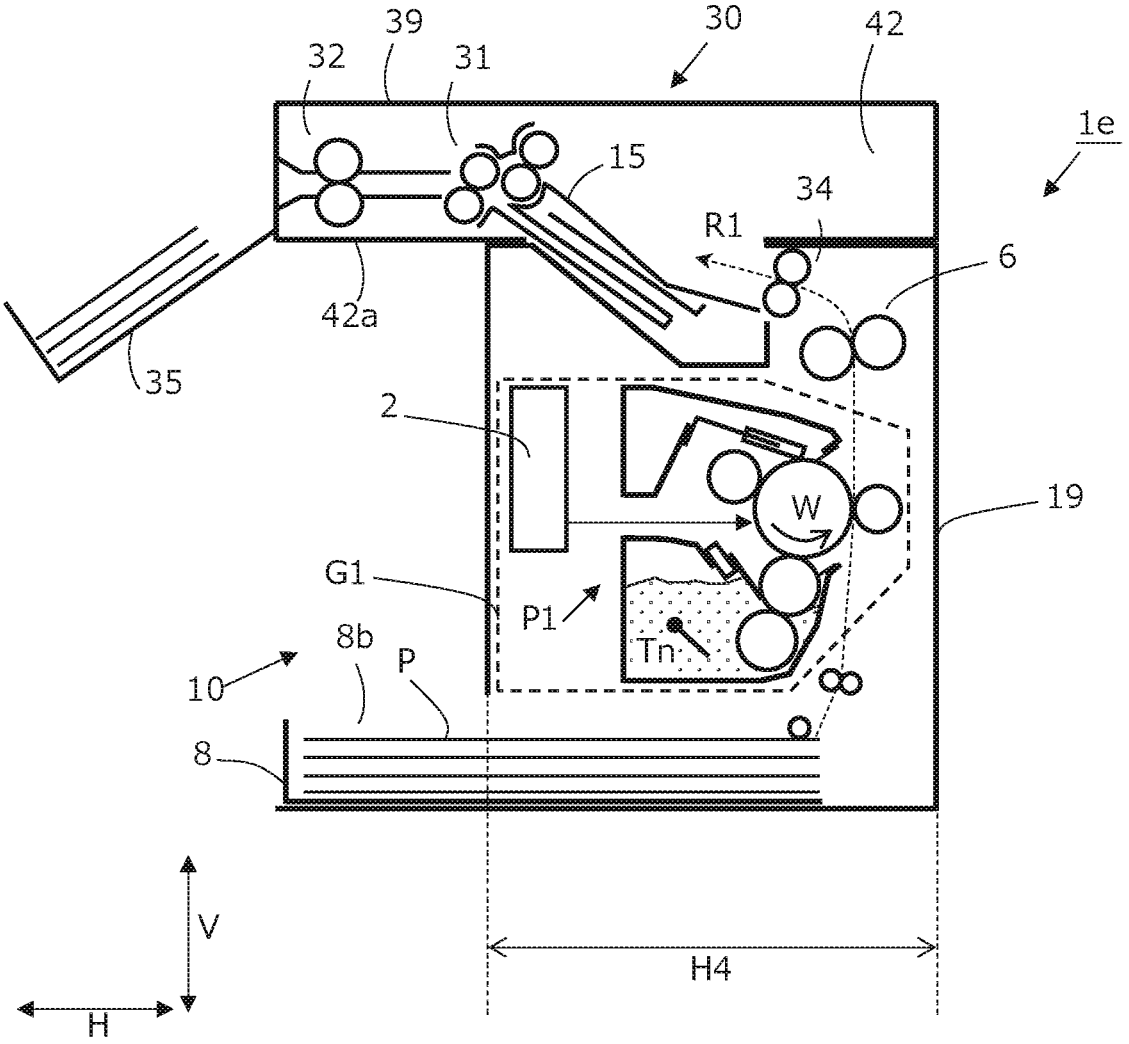
FIG. 9 is a schematic view of a sheet bonding apparatus according to a third modification example.

A sheet bonding apparatus 1*e* illustrated in FIG. 9 has a configuration in which the sheet cassette 8 projects, that is, sticks out from an occupation range H4 of the apparatus body 10 in the horizontal direction H. As a result of this, the apparatus body 10 can be miniaturized. In this configuration, the overhang portion 42*a* of the post-processing unit 30 is disposed over a projecting portion 8*b* of the sheet cassette 8 in the vertical direction V. According to such a configuration, the space above the projecting portion 8*b* of the sheet cassette 8 in the vertical direction V can be efficiently used, and thus the projected installation area of the sheet bonding apparatus 1*e* can be reduced.

Fourth Modification Example

Figure 10A:
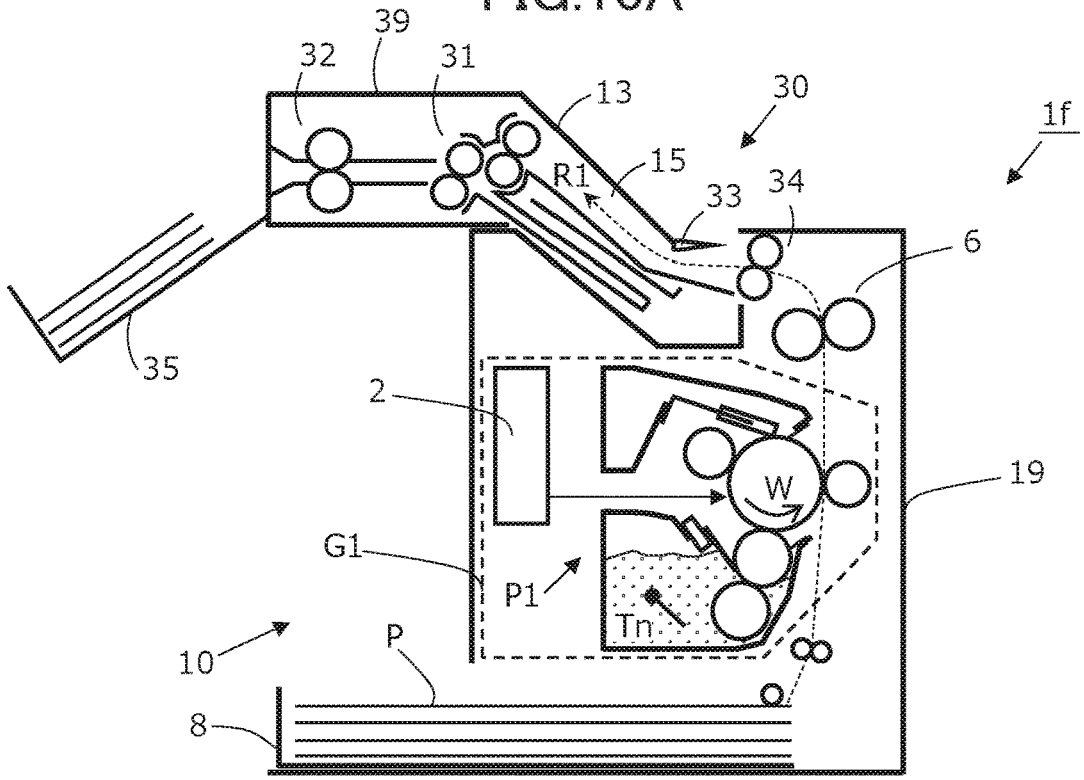
FIGS. 10A and 10B are each a schematic view of a multi-purpose apparatus according to a fourth modification example.
Figure 10B:
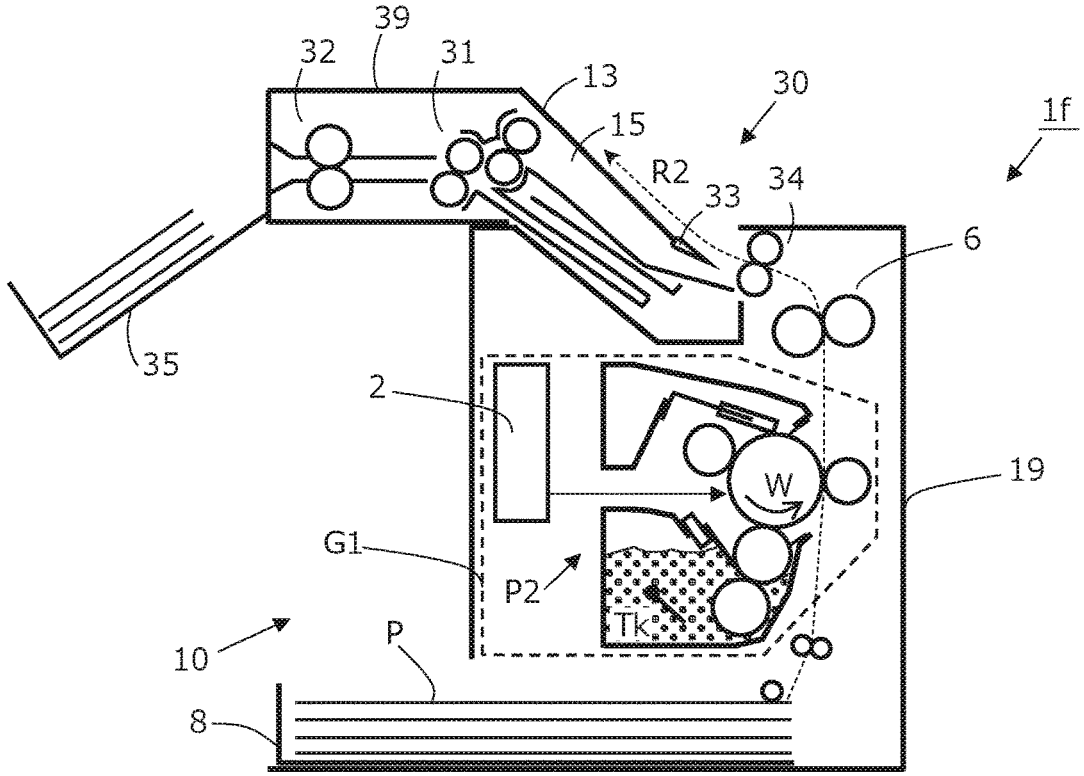

A multi-purpose apparatus if illustrated in FIGS. 10A and 10B has basically the same configuration as the sheet bonding apparatus 1*e* illustrated in FIG. 9, and is configured such that the process cartridge P1 accommodating the powder adhesive Tn and the process cartridge P2 accommodating the printing toner Tk can be switched therebetween. That is, the multi-purpose apparatus if can switch between a use mode as a sheet bonding apparatus illustrated in FIG. 10A and a use mode as an image forming apparatus illustrated in FIG. 10B by replacing the cartridge.

In the present modification example, the second discharge tray 13 onto which the sheet P on which printing has been performed by using the printing toner Tk is to be discharged is provided above the intermediate path 15. The first switching guide 33 is a guide member for switching the sheet P discharged from the discharge unit 34 to the first path R1 or the second path R2. As illustrated in FIG. 10A, in the case where the process cartridge P1 accommodating the powder adhesive Tn is attached, the position of the first switching guide 33 is controlled such that the sheet P is discharged onto the first discharge tray 35 via the first path R1. As illustrated in FIG. 10B, in the case where the process cartridge P2 accommodating the printing toner Tk is attached, the position of the first switching guide 33 is controlled such that the sheet P is discharged onto the second discharge tray 13 via the second path R2. To be noted in the case of using the apparatus as an image forming apparatus, the post-processing unit 30 may be detached from the apparatus body 10 as illustrated in FIG. 2.

As a result of this, the multi-purpose apparatus if can be used as the sheet bonding apparatus and the image forming apparatus.

Fifth Modification Example

Figure 11A:
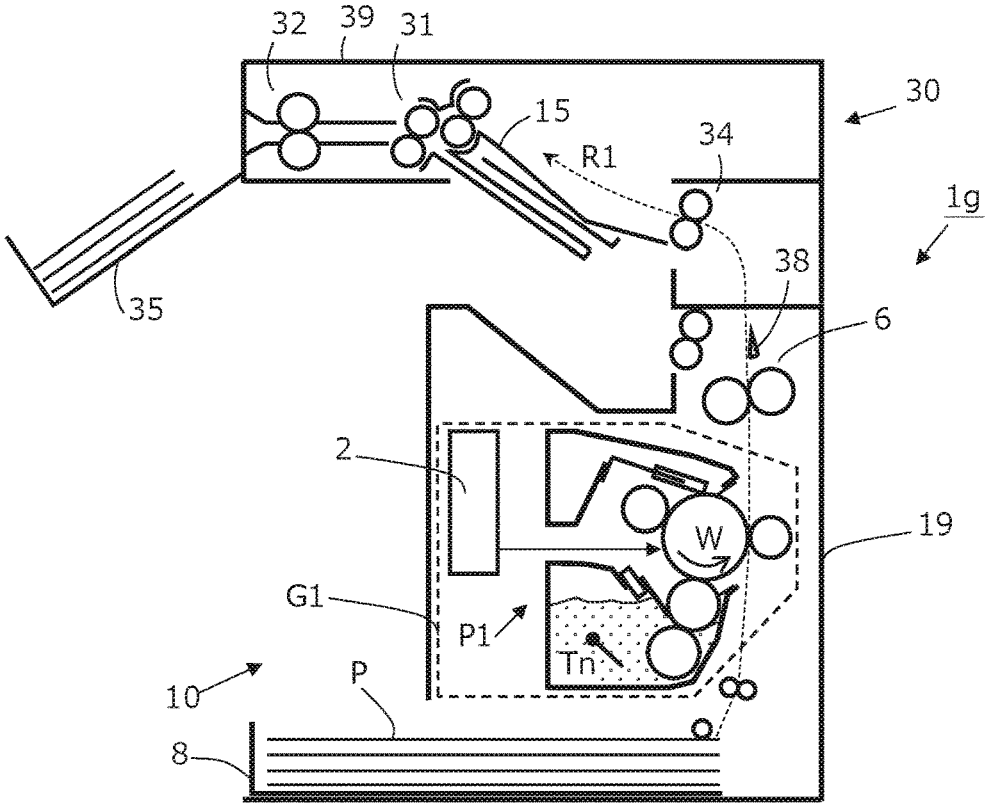
FIGS. 11A and 11B are each a schematic view of a multi-purpose apparatus according to a fifth modification example.
Figure 11B:
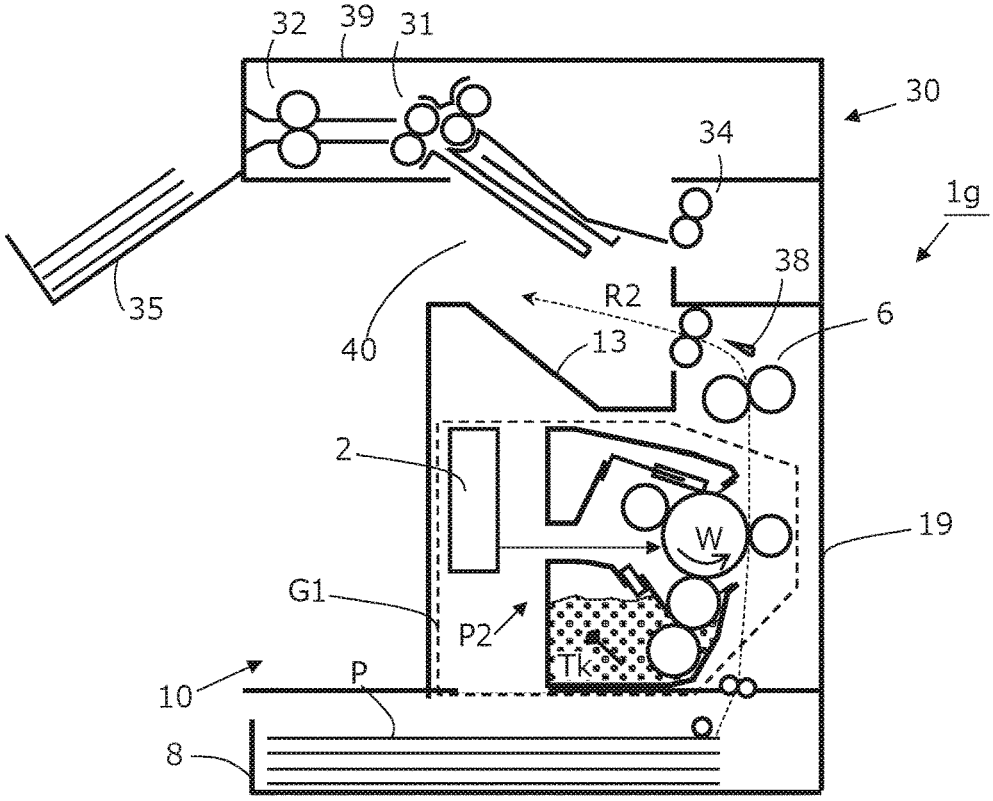

FIGS. 11A and 11B illustrate a multi-purpose apparatus 1*g* in which the space 40 is provided between the apparatus body 10 and the post-processing unit 30 in the configuration in which a use mode as a sheet bonding apparatus illustrated in FIG. 11A and a use mode as an image forming apparatus illustrated in FIG. 11B can be switched. The multi-purpose apparatus 1*g* can be used while replacing the process cartridge P1 accommodating the powder adhesive Tn and the process cartridge P2 accommodating the printing toner Tk by each other. In addition, the space 40 is provided between the apparatus body 10 and the post-processing unit 30 in the vertical direction, and the second discharge tray 13 is provided in the space 40.

In this multi-purpose apparatus 1*g*, the second switching guide 38 is provided in the apparatus body 10. The second switching guide 38 is a guide member for switching the sheet P having passed through the fixing device 6 to the first path R1 or the second path R2. As illustrated in FIG. 11A, in the case where the process cartridge P1 accommodating the powder adhesive Tn is attached, the position of the second switching guide 38 is controlled such that the sheet P is discharged onto the first discharge tray 35 via the first path R1. As illustrated in FIG. 11B, in the case where the process cartridge P2 accommodating the printing toner Tk is attached, the position of the second switching guide 38 is controlled such that the sheet P is discharged onto the second discharge tray 13 via the second path R2.

As a result of this, the multi-purpose apparatus if can be used as the sheet bonding apparatus and the image forming apparatus.

In all the third to fifth modification examples, the bonding device 32 and the folder 31 are disposed over the electrophotographic unit G1, and thus the sheet bonding apparatus 1*d* can be miniaturized while reducing the temperature rise of the powder adhesive Tn in the powder accommodating portion 104. In addition, since the powder accommodating portion 104 is disposed below the fixing device 6 and the bonding device 32, the temperature rise of the powder adhesive Tn can be more reliably reduced.

Particularly, in the multi-purpose apparatus 1*g* according to the fifth modification example, the bonding device 32 serving as a heat source is positioned away from the apparatus body 10 as a result of providing the space 40 between the apparatus body 10 and the post-processing unit 30. As a result of providing the space 40 as described above, air heated by the bonding device 32 becomes less likely to reach the powder accommodating portion 104 of the process cartridge P1. That is, the space 40 can further reduce the temperature rise of the powder adhesive Tn in the powder accommodating portion 104 caused by the heat generated by the bonding device 32.

Third Embodiment

In the first embodiment and the second embodiment described above, configurations in which the powder accommodating portion 104 of the powder adhesive Tn is provided as part of the process cartridge P1 attachable to and detachable from the apparatus body 10 has been described as an example. In the third embodiment, a configuration in which a powder unit P3 such as a powder cartridge or a powder bottle accommodating only the powder adhesive Tn or the powder adhesive Tn and the conveyance member 108 is attached to and detached from the apparatus body 10 separately from the process cartridge P1 will be described. In the description below, it is assumed that elements denoted by the same reference signs as in the first embodiment have substantially the same configurations and functions as those described in the first embodiment, and elements different from the first embodiment will be mainly described.

Figure 12:
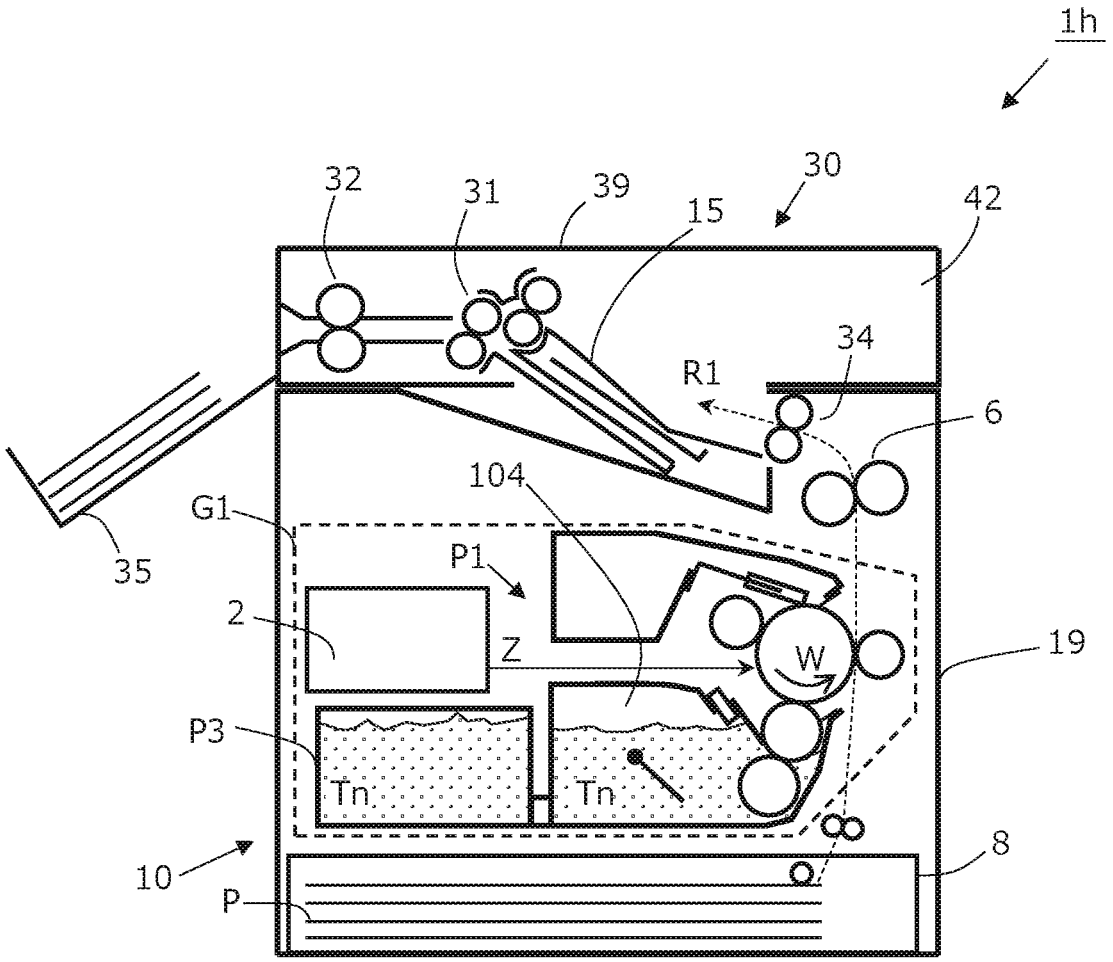
FIG. 12 is a schematic view of a sheet bonding apparatus according to a third embodiment.

In a sheet bonding apparatus 1*h* illustrated in FIG. 12, the powder unit P3 serving as a powder replenishment portion is configured to be attachable to and detachable from the apparatus body 10 of the sheet bonding apparatus 1*h* separately from the process cartridge P1. As described with reference to FIG. 5A, in the case of manufacturing a pressure-bonded postcard as a bonded product, the powder adhesive Tn is applied on the entire surface 51*a* of one side of the original sheet. In other words, the application pattern is approximately the same as a case of printing a solid image on the entire surface of a recording material. Therefore, in the case of manufacturing the pressure-bonded postcard 51, the amount of consumption of the powder adhesive Tn is particularly large. Therefore, as illustrated in FIG. 12, the powder unit P3 accommodating the powder adhesive Tn is configured to be attachable to and detachable from the sheet bonding apparatus 1*h* such that the powder accommodating portion 104 can be replenished with the powder adhesive Tn from the powder unit P3. For example, in the powder unit P3, a conveyance member such as a screw accommodated in the powder unit P3 is driven on the basis of a command from the controller, and thus the powder accommodating portion 104 is replenished with the powder adhesive Tn.

According to such a configuration, if the powder unit P3 is attached to the sheet bonding apparatus 1*h*, the frequency of replacement of the process cartridge P1 or the developing unit cartridge can be lowered even in the case where a large amount of the powder adhesive Tn is consumed in a short period, such as a case of manufacturing a large number of pressure-bonded postcards.

Sixth Modification Example

Figure 13:
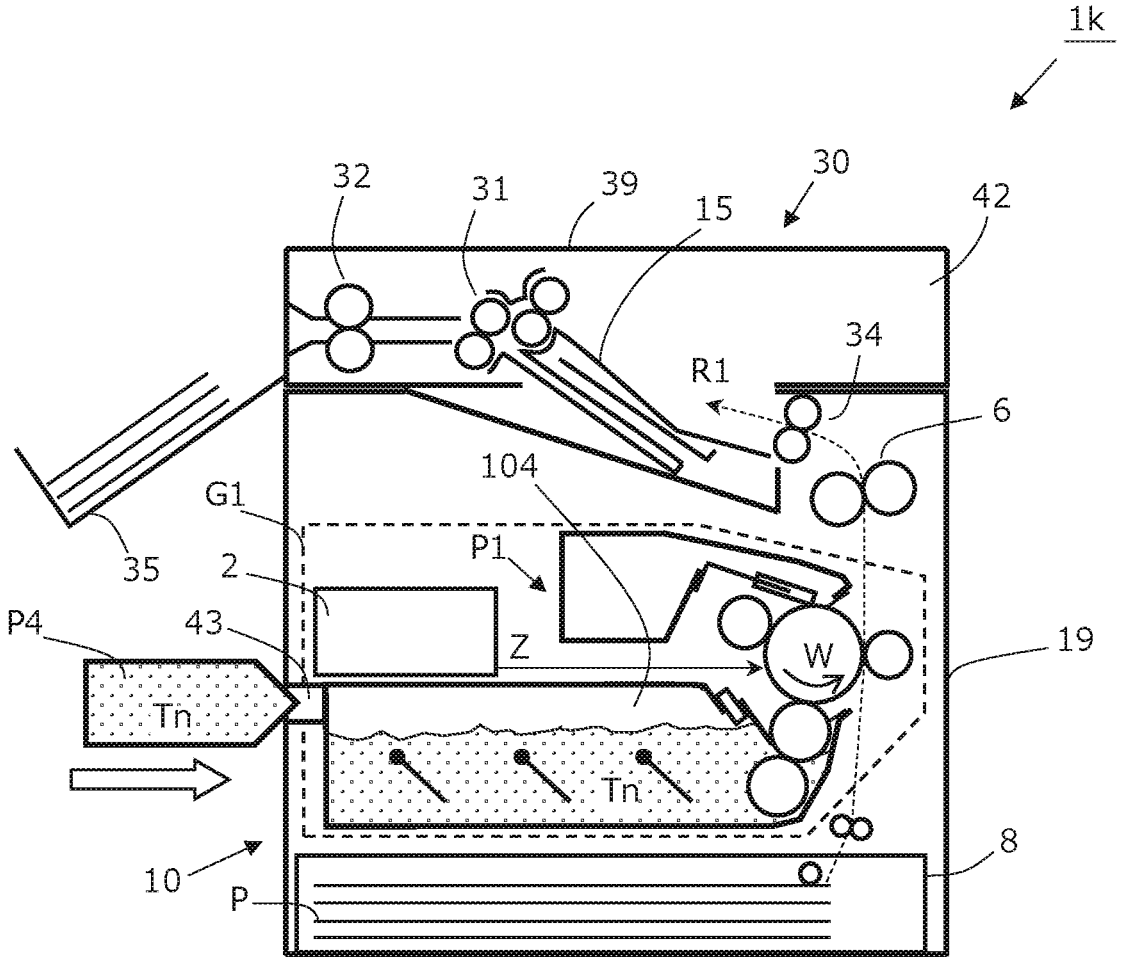
FIG. 13 is a schematic view of a sheet bonding apparatus according to a sixth modification example.

FIG. 13 illustrates a sheet bonding apparatus 1*k* that can be replenished with the powder adhesive Tn from the outside. The casing 19 of the apparatus body 10 of this sheet bonding apparatus 1*k* is provided with an external replenishment port 43 opening to the outside. The external replenishment port 43 communicates with an internal space of the powder accommodating portion 104. In addition, in the case of not performing replenishment of the powder adhesive Tn, the external replenishment port 43 is covered by a structure such as a shutter. A powder pack P4 that is a replenishment container filled with the powder adhesive Tn is attached to the external replenishment port 43, the powder adhesive Tn in the powder pack P4 is discharged, and thus only the powder adhesive Tn is charged into the powder accommodating portion 104. After the powder adhesive Tn in the powder pack P4 is charged into the powder accommodating portion 104, the powder pack P4 is detached from the sheet bonding apparatus 1*k*.

As described above, a configuration in which the powder accommodating portion 104 is replenished with only the powder adhesive Tn from the outside of the sheet bonding apparatus 1*k* by using the replenishment container can be also employed. Also according to such a configuration, the replenishment frequency of the process cartridge P1 or the developing unit cartridge can be reduced by preparing the powder pack P4 and performing the replenishment operation when necessary, even in the case of consuming a large amount of the powder adhesive Tn in a short period.

In either case of FIG. 12 and FIG. 13, the miniaturization of the sheet bonding apparatus 1*k* and reduction of the temperature rise of the powder adhesive Tn in the powder accommodating portion 104 are enabled by disposing the bonding device 32 and the folder 31 over the electrophotographic unit G1. In addition, since the powder accommodating portion 104 and the powder unit P3 are disposed below the fixing device 6 and the bonding device 32, the temperature rise of the powder adhesive Tn can be more reliably reduced.

In addition, the replenishment configuration of the powder adhesive Tn described with reference to FIGS. 12 and 13 can be combined with the configurations described in the first and second embodiments and modification examples thereof.

Other Embodiments

In each of the embodiments described above, a configuration in which the folding process and the bonding process (second heating process) are performed after the fixing process (first heating process) is performed on the sheet on which the powder adhesive Tn has been applied by the electrophotographic unit G1 has been described. Instead of this, a configuration in which the powder adhesive Tn is applied on the sheet by the electrophotographic unit G1 and the folding process and the bonding process (first heating process) are performed without performing the fixing process may be employed. In addition, a configuration in which a roller or a blade that performs the folding process also functions as an application member that applies the powder adhesive on the sheet and the application of the powder adhesive and the folding process are performed in parallel may be employed. However, if the folding process is performed after the fixing process (first heating process) as in each embodiment described above, the possibility that the powder adhesive scatters during the folding process and the inside of the apparatus is contaminated can be reduced.

As described above, according to the present disclosure, miniaturization of the apparatus or reduction of temperature rise of the powder adhesive can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-108390, filed on Jun. 30, 2021, which is hereby incorporated by reference herein in its entirety.

What is claimed is:

1. A sheet bonding apparatus comprising:

a first casing;

a second casing mounted on a top of the first casing;

an electrophotographic unit accommodated in the first casing and configured to apply powder adhesive on a sheet by an electrophotographic process;

a folding portion accommodated in the second casing and configured to fold the sheet on which the powder adhesive has been applied by the electrophotographic unit; and a bonding portion accommodated in the second casing and configured to heat the sheet folded by the folding portion to bond the sheet by the powder adhesive, wherein the bonding portion and the folding portion are disposed over the electrophotographic unit, wherein the second casing includes an overhang portion overhanging to an outside of a range occupied by the first casing as viewed in a vertical direction, and wherein at least part of the bonding portion is disposed in the overhang portion.

2. The sheet bonding apparatus according to claim 1, further comprising a fixing portion configured to heat and fix the powder adhesive applied on the sheet by the electrophotographic unit, wherein the folding portion is configured to fold the sheet having passed the fixing portion.

3. The sheet bonding apparatus according to claim 2, further comprising:

a sheet accommodating portion disposed below the electrophotographic unit and configured to accommodate a sheet;

a feeding member configured to feed the sheet accommodated in the sheet accommodating portion to a first side in a horizontal direction; and a conveyance member configured to convey the sheet on which the powder adhesive has been applied by the electrophotographic unit to a second side opposite to the first side in the horizontal direction toward the folding portion, wherein the fixing portion is disposed on a sheet conveyance path extending upward to the conveyance member from the feeding member on the first side in the horizontal direction with respect to the electrophotographic unit, and wherein the bonding portion is disposed on a sheet conveyance path which extends, over the electrophotographic unit, to the second side in the horizontal direction from the conveyance member via the folding portion.

4. The sheet bonding apparatus according to claim 1, further comprising a discharge tray onto which the sheet bonded by the bonding portion is discharged, wherein the discharge tray is disposed above a space where the powder adhesive is accommodated in the electrophotographic unit.

5. The sheet bonding apparatus according to claim 1, wherein the sheet bonding apparatus does not include an image forming portion configured to form an image on a sheet by using printing toner.

6. The sheet bonding apparatus according to claim 1, wherein at least part of the electrophotographic unit is a cartridge attachable to and detachable from the sheet bonding apparatus, and wherein the sheet bonding apparatus is capable of switching between (i) a state in which a first cartridge accommodating the powder adhesive is attached thereto as the cartridge and in which the sheet bonding apparatus is capable of bonding a sheet by the powder adhesive, and (ii) a state in which a second cartridge accommodating printing toner is attached thereto as the cartridge and in which the sheet bonding apparatus is capable of forming an image on a sheet by the printing toner.

7. The sheet bonding apparatus according to claim 6, further comprising:

a first discharge tray onto which the sheet bonded by the powder adhesive is discharged in a state in which the first cartridge is attached to the sheet bonding apparatus; and a second discharge tray onto which the sheet on which the image is formed by the printing toner is discharged in a state in which the second cartridge is attached to the sheet bonding apparatus, wherein at least one of the first discharge tray and the second discharge tray is disposed over the electrophotographic unit.

8. The sheet bonding apparatus according to claim 7, wherein the folding portion and the bonding portion are disposed over the second discharge tray, and wherein a space where the sheet on which the image is formed by the printing toner is provided between the bonding portion and the second discharge tray in a vertical direction.

9. The sheet bonding apparatus according to claim 1, wherein the electrophotographic unit includes a photosensitive member, a charging portion configured to charge a surface of the photosensitive member, an exposing portion configured to expose the charged surface of the photosensitive member to form an electrostatic latent image corresponding to an application pattern of the powder adhesive, a developing portion configured to develop the electrostatic latent image by using the powder adhesive as developer, and a transfer portion configured to transfer the pattern of the powder adhesive developed on the surface of the photosensitive member onto a sheet.

10. A sheet bonding apparatus comprising:

an electrophotographic unit configured to apply powder adhesive on a sheet by an electrophotographic process;

a folding portion configured to fold the sheet on which the powder adhesive has been applied by the electrophotographic unit; and a bonding portion configured to heat the sheet folded by the folding portion to bond the sheet by the powder adhesive, wherein the bonding portion and the folding portion are disposed over the electrophotographic unit, wherein the electrophotographic unit includes a powder accommodating portion configured to accommodate the powder adhesive, wherein a bottom portion of the powder accommodating portion is positioned below a lower end portion of the bonding portion in a vertical direction, wherein the sheet bonding apparatus further comprises a powder replenishment portion connected to the powder accommodating portion and configured to replenish the powder accommodating portion with the powder adhesive, and wherein a bottom portion of the powder replenishment portion is positioned below the lower end portion of the bonding portion in the vertical direction.

11. The sheet bonding apparatus according to claim 10, wherein a whole of the powder accommodating portion and a whole of the powder replenishment portion are positioned below the lower end portion of the bonding portion in the vertical direction.

12. The sheet bonding apparatus according to claim 10, wherein the powder replenishment portion is configured to be attachable to and detachable from the sheet bonding apparatus.

13. The sheet bonding apparatus according to claim 10, wherein the powder accommodating portion is connected to a replenishment port opening to an outside of the sheet bonding apparatus such that the powder accommodating portion is replenished with the powder adhesive from the outside of the sheet bonding apparatus through the replenishment port.

14. A sheet bonding apparatus comprising:

an electrophotographic unit configured to apply powder adhesive on a sheet by an electrophotographic process;

a folding portion configured to fold the sheet on which the powder adhesive has been applied by the electrophotographic unit;

a bonding portion configured to heat the sheet folded by the folding portion to bond the sheet by the powder adhesive; and a discharge tray onto which the sheet bonded by the bonding portion is discharged, wherein the discharge tray is disposed above a space in the electrophotographic unit where the powder adhesive is accommodated, and wherein the discharge tray overhangs to an outside of a casing accommodating the electrophotographic unit as viewed in a vertical direction.

15. The sheet bonding apparatus according to claim 14, wherein a length in a sheet conveyance direction of the discharge tray is smaller than a length in the sheet conveyance direction of a largest sheet that the bonding portion is capable of bonding.

* * * * *